US007624894B2

(12) United States Patent
Gerold et al.

(10) Patent No.: US 7,624,894 B2
(45) Date of Patent: Dec. 1, 2009

(54) AUTOMATED PILL-DISPENSING APPARATUS

(76) Inventors: William Olin Gerold, 3439 Snow Rd., Bridgman, MI (US) 49106-9743; William Jason Gerold, 3439 Snow Rd., Bridgman, MI (US) 49106-9743

( * ) Notice: Subject to any disclaimer, the term of this patent is extended or adjusted under 35 U.S.C. 154(b) by 191 days.

(21) Appl. No.: 11/193,174

(22) Filed: Jul. 29, 2005

(65) Prior Publication Data

US 2005/0263537 A1 Dec. 1, 2005

Related U.S. Application Data

(63) Continuation-in-part of application No. 10/160,970, filed on May 31, 2002, now Pat. No. 7,210,598.

(60) Provisional application No. 60/626,797, filed on Nov. 10, 2004.

(51) Int. Cl.
*B65H 3/44* (2006.01)

(52) U.S. Cl. ..... 221/124; 221/258; 221/123; 221/186; 221/188; 221/200; 221/288; 700/231; 700/241

(58) Field of Classification Search ..... 700/231–244; 221/1–312 C
See application file for complete search history.

(56) References Cited

U.S. PATENT DOCUMENTS 3,227,500 A 1/1966 Sawrey
3,305,067 A 2/1967 Mayer
3,502,382 A 3/1970 Rainey (Continued)

FOREIGN PATENT DOCUMENTS

WO WO0228553 4/2002

OTHER PUBLICATIONS

Appendix A discloses a "Declaration of William O. Gerold . . . " dated May 23, 2005, but referring to a "Breed Dispensing System developed in 1997, wherein Mr. Gerold, the present inventor, on p. 2, paragraph 7, states The Breed system used a hopper and track system similar to that of the original Microfil system that used vibration." The original Microfil system referred to is that shown in the application U.S. Appl. No. 10/160,970. This fact came out during litigation and Applicant is hereby disclosing it under their duty of disclosure to the U.S.P.T.O.

(Continued)

*Primary Examiner*—Gene Crawford
*Assistant Examiner*—Michael K Collins
(74) *Attorney, Agent, or Firm*—Price, Heneveld, Cooper, DeWitt & Litton, LLP

(57) ABSTRACT

A pill-dispensing apparatus for automatically dispensing solid pills includes a plurality of storage units and a pill dispensing module. The storage units store pills in bulk and each include a hopper and an auger movably positioned with respect to the hopper. An inlet of the auger is positioned to receive pills from the hopper. The pill-dispensing module includes: a dock for receiving and holding a selected one of the storage units, a drive unit for rotating the auger to motivate the pills along the auger, a pill counter for counting pills dispensed from an auger outlet, and a lift for tilting the hopper to control flow and to assist in motivating pills to fall from the hopper and move along the auger.

20 Claims, 32 Drawing Sheets

U.S. PATENT DOCUMENTS

| | | | | |
|---|---|---|---|---|
| 3,925,960 | A | 12/1975 | Saari et al. | |
| 4,469,217 | A * | 9/1984 | Meyer et al. | 198/419.2 |
| 4,546,901 | A | 10/1985 | Buttarazzi | |
| 4,651,868 | A | 3/1987 | Sticht | |
| 4,843,579 | A | 6/1989 | Andrews et al. | |
| 4,844,236 | A | 7/1989 | Kraus | |
| 5,213,232 | A * | 5/1993 | Kraft et al. | 221/277 |
| 5,244,020 | A * | 9/1993 | Bruno et al. | 141/83 |
| 5,348,061 | A | 9/1994 | Riley et al. | |
| 5,473,703 | A | 12/1995 | Smith | |
| 5,511,690 | A | 4/1996 | Calhoun et al. | |
| 5,852,911 | A | 12/1998 | Yuyama et al. | |
| 5,884,806 | A * | 3/1999 | Boyer et al. | 221/75 |
| 5,901,876 | A | 5/1999 | Yuyama et al. | |
| 5,967,294 | A | 10/1999 | Patterson et al. | |
| 5,988,858 | A | 11/1999 | Yuyama et al. | |
| 6,131,765 | A | 10/2000 | Barry et al. | |
| 6,145,700 | A | 11/2000 | Takahashi et al. | |
| 6,179,117 | B1 | 1/2001 | Gilman | |
| 6,181,982 | B1 | 1/2001 | Yuyama et al. | |
| 6,189,683 | B1 | 2/2001 | Svejkovsky et al. | |
| 6,206,235 | B1 | 3/2001 | Green | |
| 6,286,658 | B1 | 9/2001 | Hufford | |
| 6,298,978 | B1 | 10/2001 | Rosenstrom | |
| 6,308,109 | B1 | 10/2001 | Yuyama et al. | |
| 6,394,308 | B1 | 5/2002 | Yuyama et al. | |
| 6,415,913 | B2 | 7/2002 | Sleppy et al. | |
| 6,422,418 | B1 | 7/2002 | Collins et al. | |
| RE37,829 | E | 9/2002 | Charhut et al. | |
| 6,449,927 | B2 | 9/2002 | Hebron et al. | |
| 6,505,093 | B1 | 1/2003 | Thatcher et al. | |
| 6,611,733 | B1 | 8/2003 | De La Huerga | |
| 6,631,799 | B2 | 10/2003 | Samson | |
| 6,742,671 | B2 | 6/2004 | Hebron et al. | |
| 7,210,598 | B2 * | 5/2007 | Gerold et al. | 221/123 |
| 2005/0113968 | A1 * | 5/2005 | Williams et al. | 700/236 |
| 2008/0017657 | A1 * | 1/2008 | Hutchinson et al. | 221/13 |
| 2008/0041872 | A1 * | 2/2008 | Shows et al. | 221/9 |

OTHER PUBLICATIONS

Appendix B is a Memorandum Opinion dated Jan. 18, 2006, signed by U.S. District Judge Samual Der-Yeghiayan.

FMC Technologies, "Electromagnetic Vibrating Feeders (Light-Duty)", Apr. 27, 2002 (2 pages).

Meyer Machine Company, "Vibratory Feeders", date unknown (2 pages).

* cited by examiner

AUTOMATED PILL-DISPENSING APPARATUS

CROSS-REFERENCE TO RELATED APPLICATIONS

This application claims the benefit of U.S. Provisional Patent Application Ser. No. 60/626,797, entitled "AUTOMATED PILL-DISPENSING APPARATUS," by William Olin Gerold et al., filed Nov. 10, 2004, and is a continuation-in-part of U.S. patent application Ser. No. 10/160,970, entitled "AUTOMATED PILL-DISPENSING APPARATUS," by William O. Gerold et al., filed on May 31, 2002, now U.S. Pat. No. 7,210,598 the disclosures of which are hereby incorporated herein by reference in their entirety.

BACKGROUND

The present invention relates to automated pill-dispensing apparatus, and more particularly relates to a modular compact pill-dispensing apparatus for automated dispensing of pills in retail pharmacy environments.

There is a need to optimize use of pharmacist time, since the time of a pharmacist is expensive. In particular, there is a need to let a pharmacist use his/her expertise without burdening him/her with mundane work such as counting pills and placing them in bottles. Further, it is desirable to reduce the amount of time a pharmacist spends walking around the pharmacy area, not only to reduce wasted time but also to reduce fatigue of the pharmacist as the day progresses.

There is further a need to optimize the density of storage of pills. In many pharmacies, pills are stored in every nook and cranny possible. Also, the logistics of stored pills relative to the customers and to the pharmacist, should preferably be improved. As part of the logistics, it is important to keep in mind the security of pills, the cleanliness, and the ability to keep the areas clean, especially in the retail environment where cleanliness can be a problem.

Another concern is equipment. Any automated equipment must be compact, flexible, and adjustable for optimally handling different types of pills. However, standardized components should preferably be used, including components that are easily serviceable, fixable on site, reliable, robust, durable, low maintenance, simple to operate, low-cost, and that require a relatively lower capital investment. Further, any programmed features must be configured to optimize quality control and efficiency and control of the operation.

There is a need to increase the accuracy and reduce the errors in filling prescriptions. As part of this, there is a need to improve pill handling and accuracy of pills counts. These are difficult problems, because of the difference in sizes and shapes of pills make pill handling difficult. At the same time, different sizes and shapes of pills are required so that a pharmacist (and patient) can recognize wrong pills. Further, pill handling must deal with quality control issues, including the fact that pill counting is a relatively mundane and boring task.

There is a need to provide adjustability and reliability in pill handling equipment. There is a need to be able to adjust for different pills on site without requiring customized specially-ordered equipment or part. There is a need to reliably and accurately drop pills into vials, while still providing the flexibility that will allow pharmacists to still provide the human control required for dispensing medicines critical to the health of patients, Another issue is security. Any automated equipment should provide good security and resistance to theft and tampering. As part of this software and programming, it is desirable to provide a refill procedure that not only controls refilling and prevents errors in filling storage units with wrong pills, but also that keeps track of pill counts.

Accordingly, an automated apparatus is desired that provides the advantages noted above and that solves the disadvantages.

SUMMARY OF THE PRESENT INVENTION

According to one embodiment of the present invention, a pill-dispensing apparatus for automatically dispensing solid pills includes a plurality of storage units and a pill dispensing module. The storage units store pills in bulk and each include a hopper and an auger movably positioned with respect to the hopper. An inlet of the auger is positioned to receive pills from the hopper. The pill-dispensing module includes: a dock for receiving and holding a selected one of the storage units, a drive unit for rotating the auger to motivate the pills along the auger, a pill counter for counting pills dispensed from an auger outlet, and a lift for tilting the hopper to control flow and to assist in motivating pills to fall from the hopper and move along the auger.

These and other aspects, objects, and features of the present invention will be understood and appreciated by those skilled in the art upon studying the following specification, claims, and appended drawings.

BRIEF DESCRIPTION OF DRAWINGS

FIG. 30 shows the internal hopper raised so that the gate is very open in a large-gap position;

DETAILED DESCRIPTION OF PREFERRED EMBODIMENTS

Figure 1:
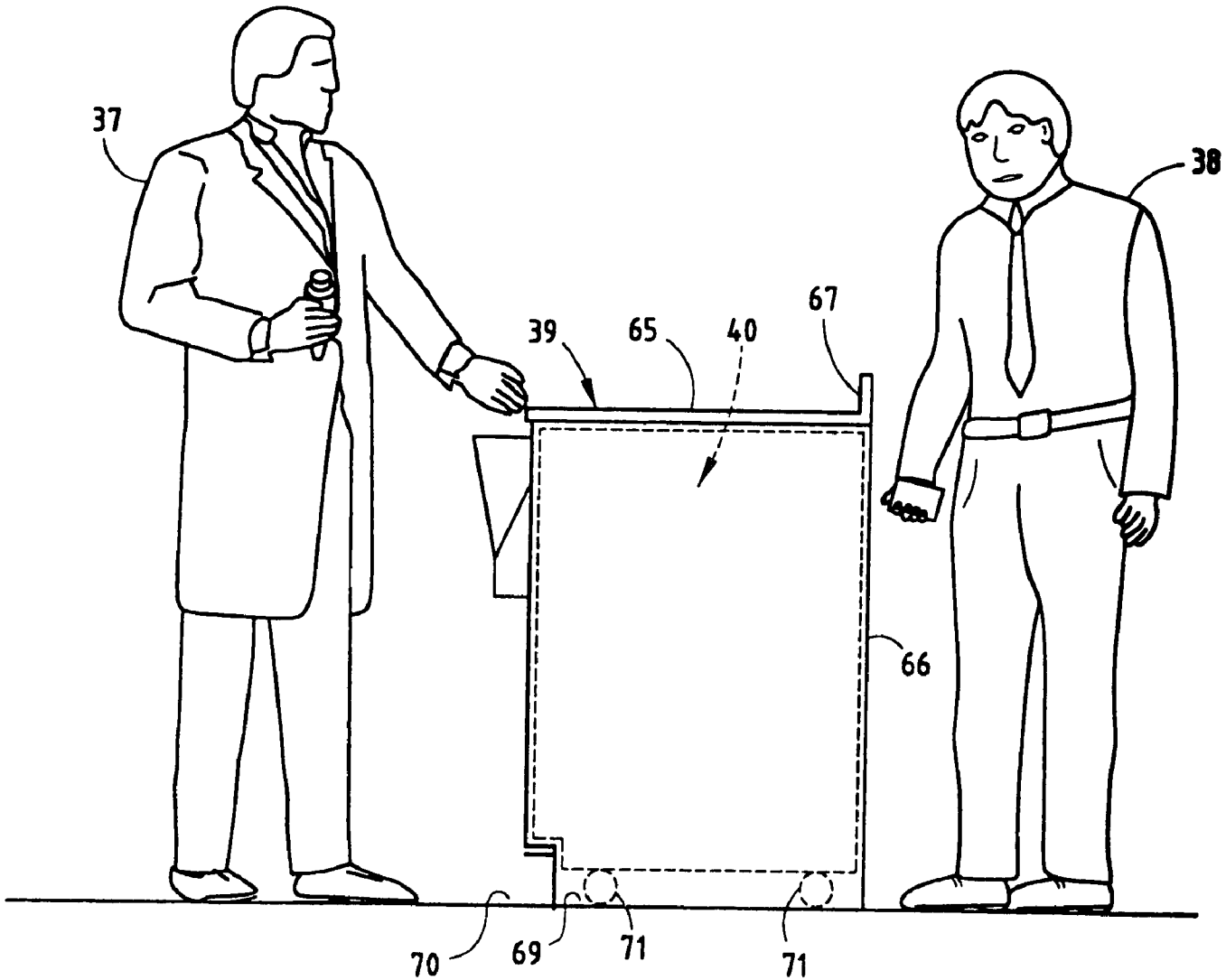
FIG. 1 discloses a side view of a pharmacist countertop, including the present apparatus under the countertop.
Figure 2:
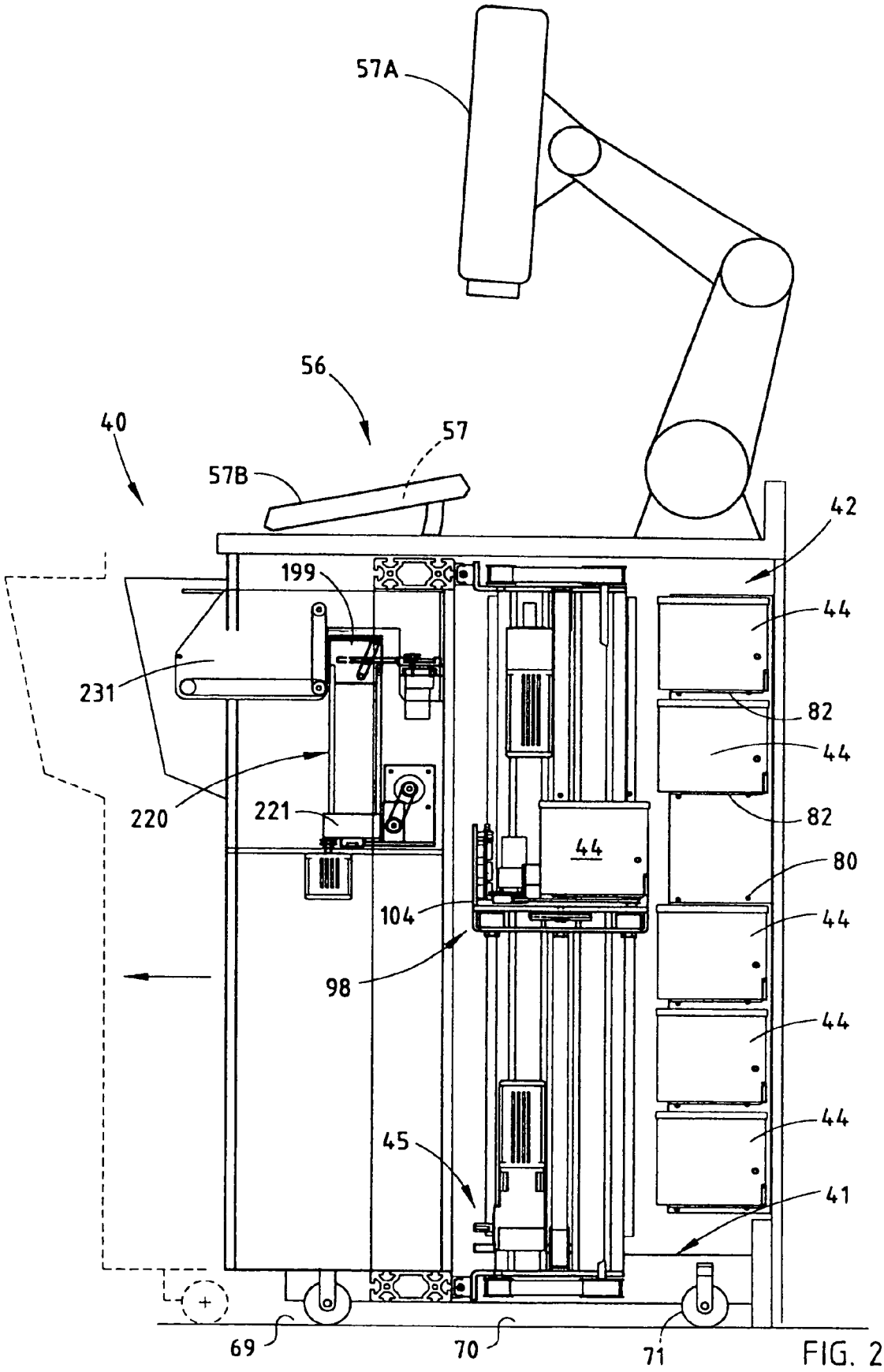
FIGS. 2-4 are side, front, and top orthogonal views of the apparatus shown in FIG. 1, with panels removed to better show the apparatus.
Figure 4:
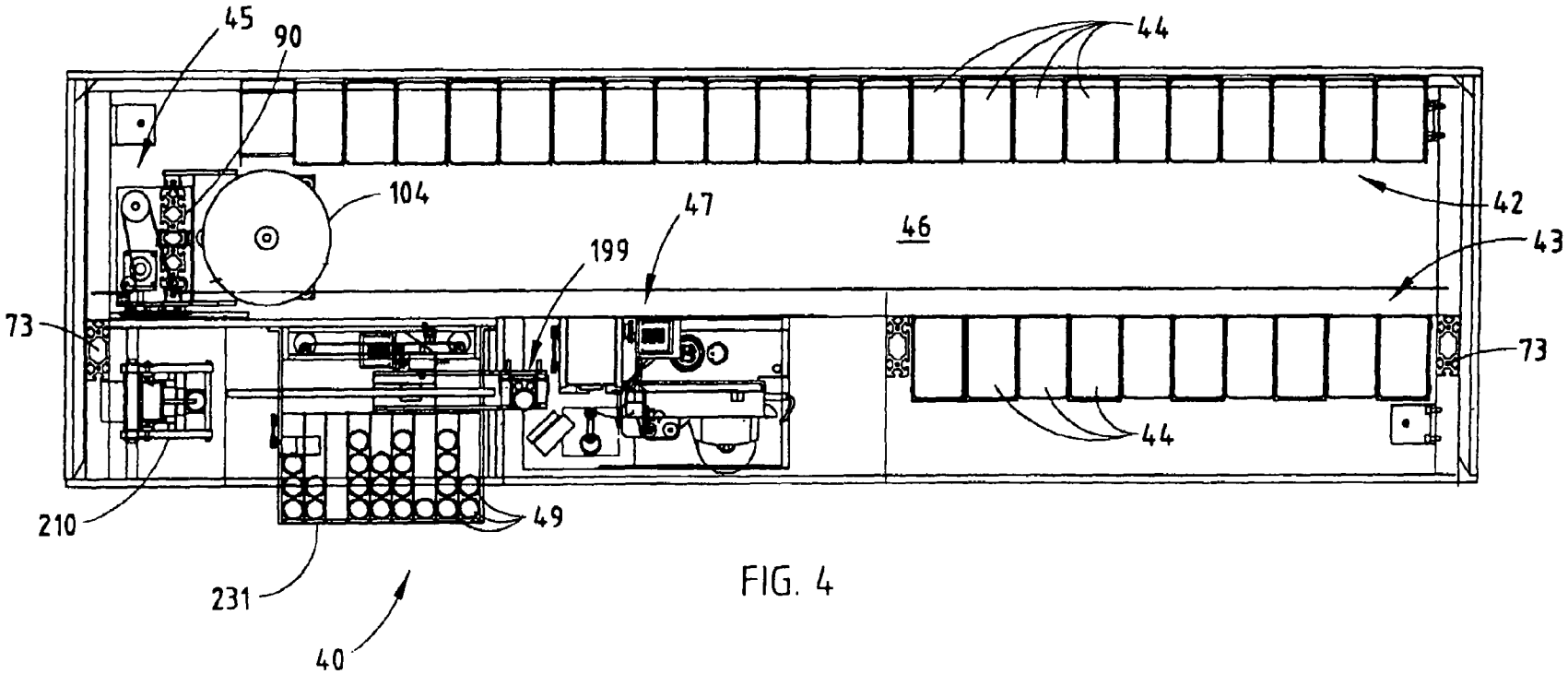
Figure 4A:
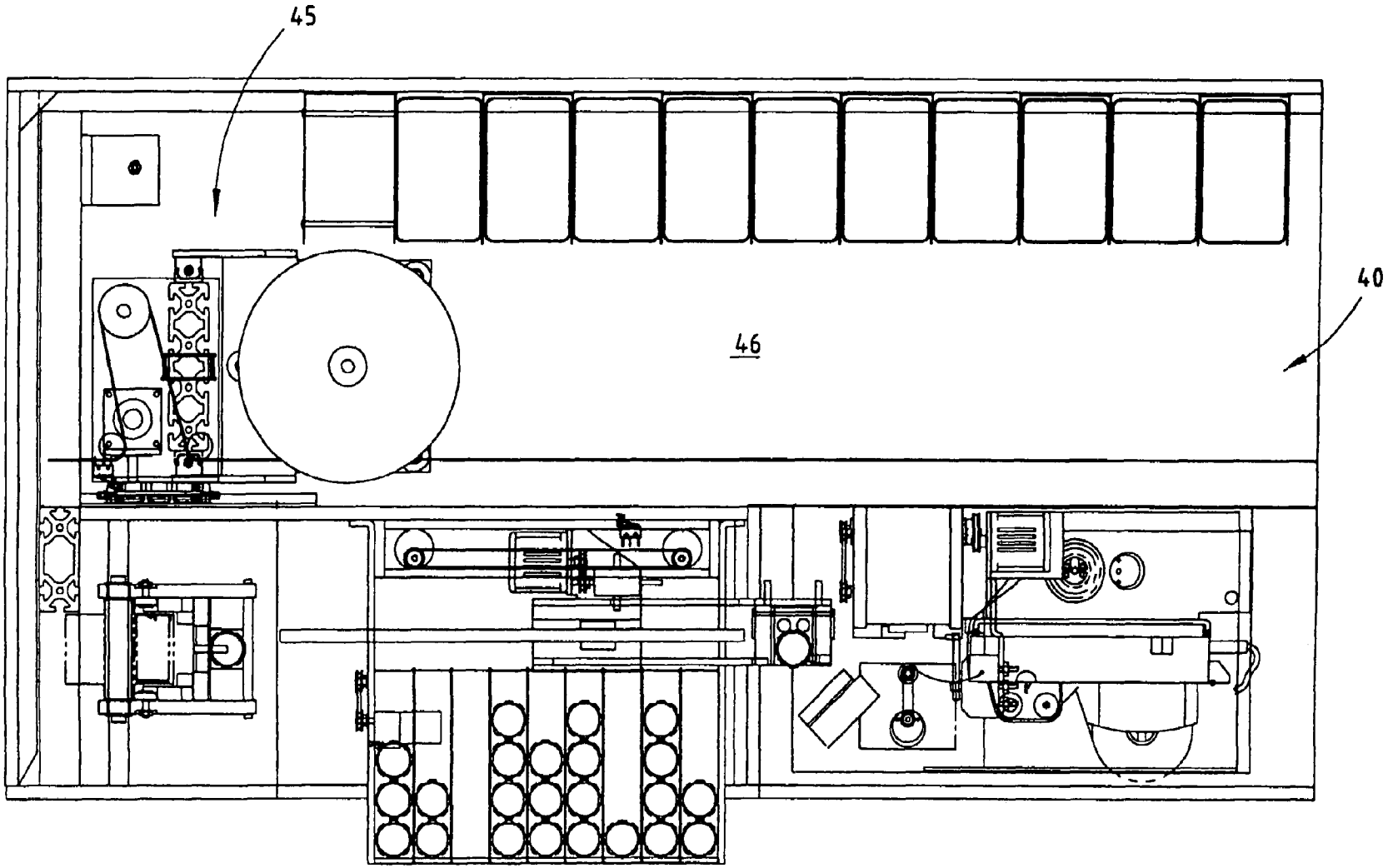
FIG. 4A is an enlarged partial view of the left hand-portion of FIG. 4.
Figure 12:
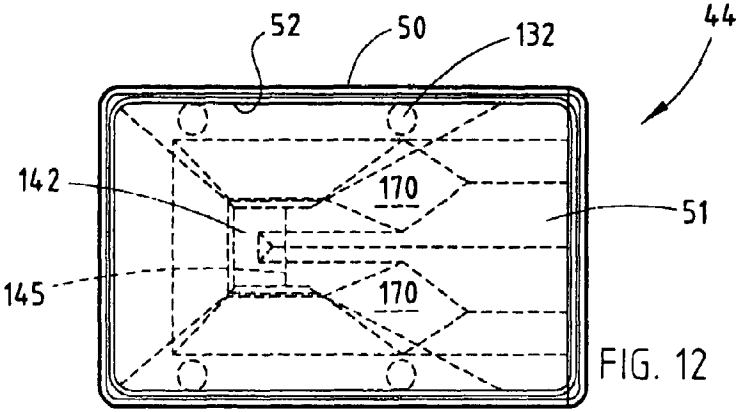
Figure 12A:
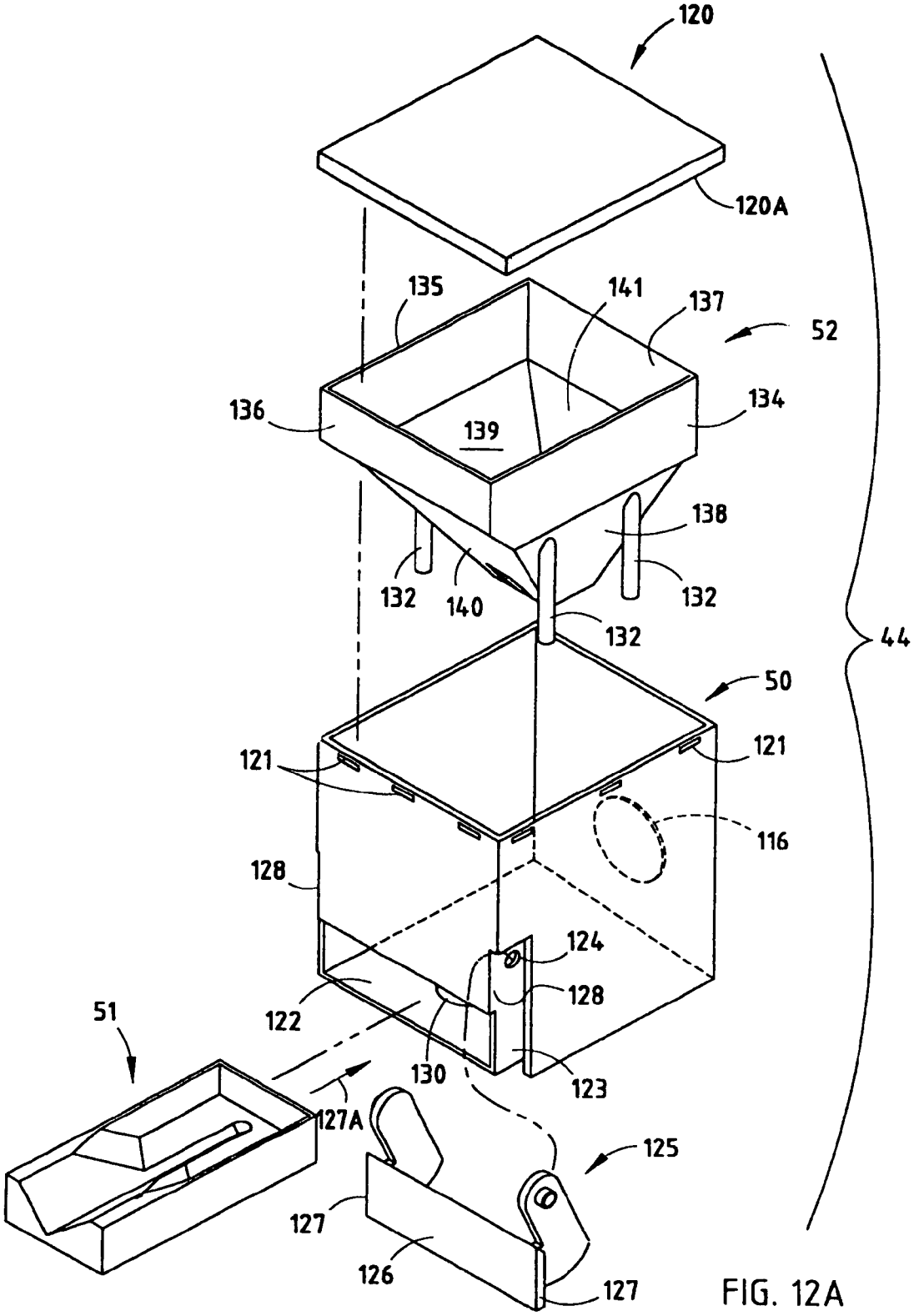
FIG. 12A is an exploded perspective view of the storage unit shown in FIG. 10.
Figure 14:
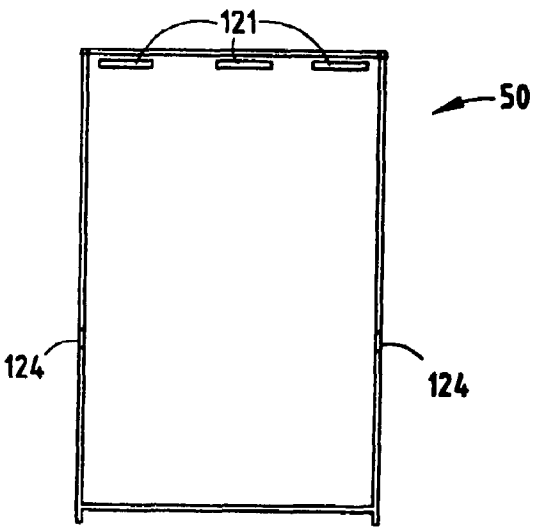
FIGS. 13-15 are side, top, and bottom views of the outer container shown in FIG. 12A.
Figure 13:
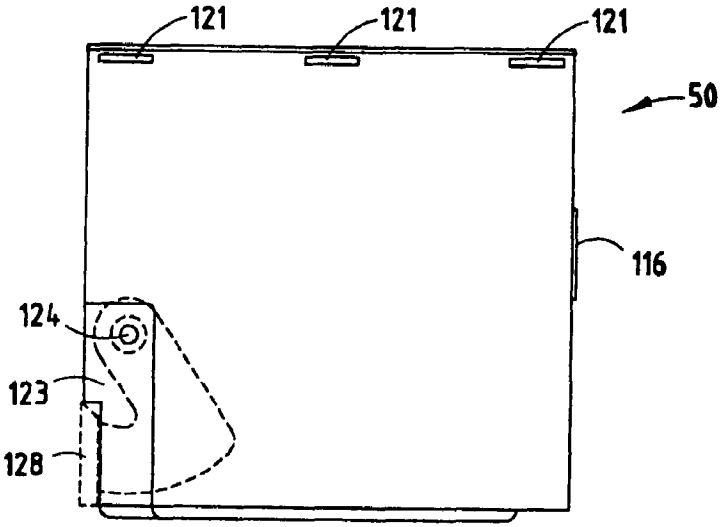
Figure 33:
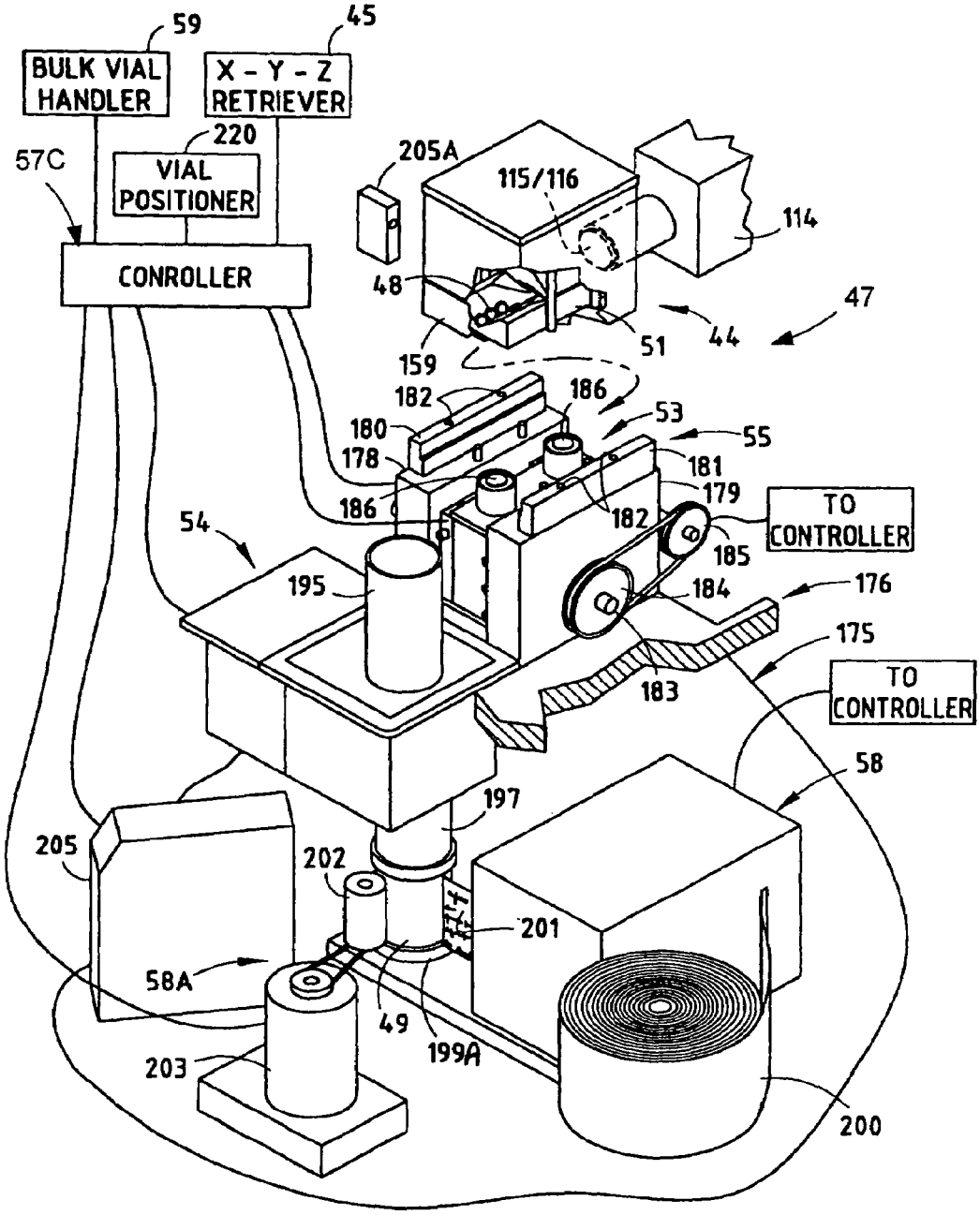
FIG. 33 is a perspective view of the pill-dispensing module.

A portable automatic pill-dispensing apparatus 40 (FIG. 1) includes a wheeled mobile frame 41 located under a countertop 39 in a position allowing a pharmacist 37 to serve a customer 38 and simultaneously fill prescriptions while standing at the countertop 39. The apparatus 40 carries two parallel stacked arrays 42 and 43 (FIG. 4) of storage units 44 for storing pills, tablets, capsules, and similar medication units 48 (hereafter called "pills") in bulk, an x-y-z retriever module 45 (FIG. 7) positioned in an aisle 46 between the two arrays for retrieving selected ones of the storage units 44, and a pill-dispensing module 47 (FIG. 33) for unloading pills 48 into vials 49. The storage units 44 (FIG. 12A) each include a rectangular outer container 50, a vibrating pill track 51 (also called a "feed block" or "drive unit") positioned in a bottom of the outer container 50, and a hopper 52 movably positioned within the outer container 50 for vertical movement toward and away from the track 51. The pill-dispensing module 47 (FIG. 33) includes a vibrator or oscillator 53 for the track 51, a pill counter 54, and a lift 55 for lifting the hopper 52 to break bunched-up and "bridged" pills 48. A prescription information station 56 (FIG. 2) is provided including a computer 57, screen or monitor 57A and keyboard 57B for storing, viewing, and inputting patient prescription information, a printer 58 and applicator 58A (FIG. 33) for printing a label for the vial 49 and for applying the label to the vial 49. A controller 57C is operably connected to the pill-dispensing module 47, the retriever module 45, a bulk vial handling device 59, and the printer 58 for operating the system.

Space is expensive in retail environments, such as in retail chain stores and local retail drug stores. Typically, pills are stored in bulk in a location well behind a countertop, where the pills are safe from theft, and where there is sufficient room to store the pills in head-high dense-storage cabinets. However, this requires space in the pharmacy area, and further this requires that the pharmacist walk back and forth between customer/patients and the storage cabinets. The present apparatus 40 provides tremendous improvements in reduced space requirements, increased security and density of pill storage, reduce wear on the pharmacist, and improved efficiency and accuracy and timeliness of the operation of filling prescriptions.

The countertop 39 (FIG. 1) includes a work surface 65, side and back panels 66 supporting the work surface 65 at an elbow height, so that the countertop 39 is optimally suited for use by a standing pharmacist sorting and handling pills on its top surface. A front lip 67 may be provided if desired to hold papers and items on the countertop 39. The lip 67 also creates a division from customers/patients, which may be desirable such as for keeping customers/ patients from leaning on the countertop 39. The "pharmacist side" of area under the countertop 39 is open. A bump 69 (FIG. 2) may be positioned on a floor surface 70 to engage the wheels 71 of the frame 41 to positively but releasably hold the apparatus 40 under the countertop 39. It is contemplated that a number of different detent arrangements can be used to hold the apparatus 40 under the countertop 39. Notably, it is also contemplated that the present apparatus 40 can be used in locations other than under a countertop, and that the device can be extended vertically to be much higher than waist high. Nonetheless, the optimal arrangement is shown in the figures.

The mobile frame 41 (FIG. 7) includes a pair of inverted T-shaped side frame members 73 connected together by top and bottom beams 74 and 75. Additional components may be attached to the frame 41 for increased rigidity, such as top, side, bottom, and front panels 76, 77, 78, and 79, which enclose a front half of the frame 41. Also, an intermediate panel 79A can be added for increased stiffness, if needed. However, low weight is potentially important to the apparatus 40 in order to make it semi-easy to move. For this reason, the frame members 73-75 are made of high-strength aluminum extrusions or similar lightweight, high-strength materials. Naturally, a size of the frame 41 also affects the frame requirements.

Figure 7:
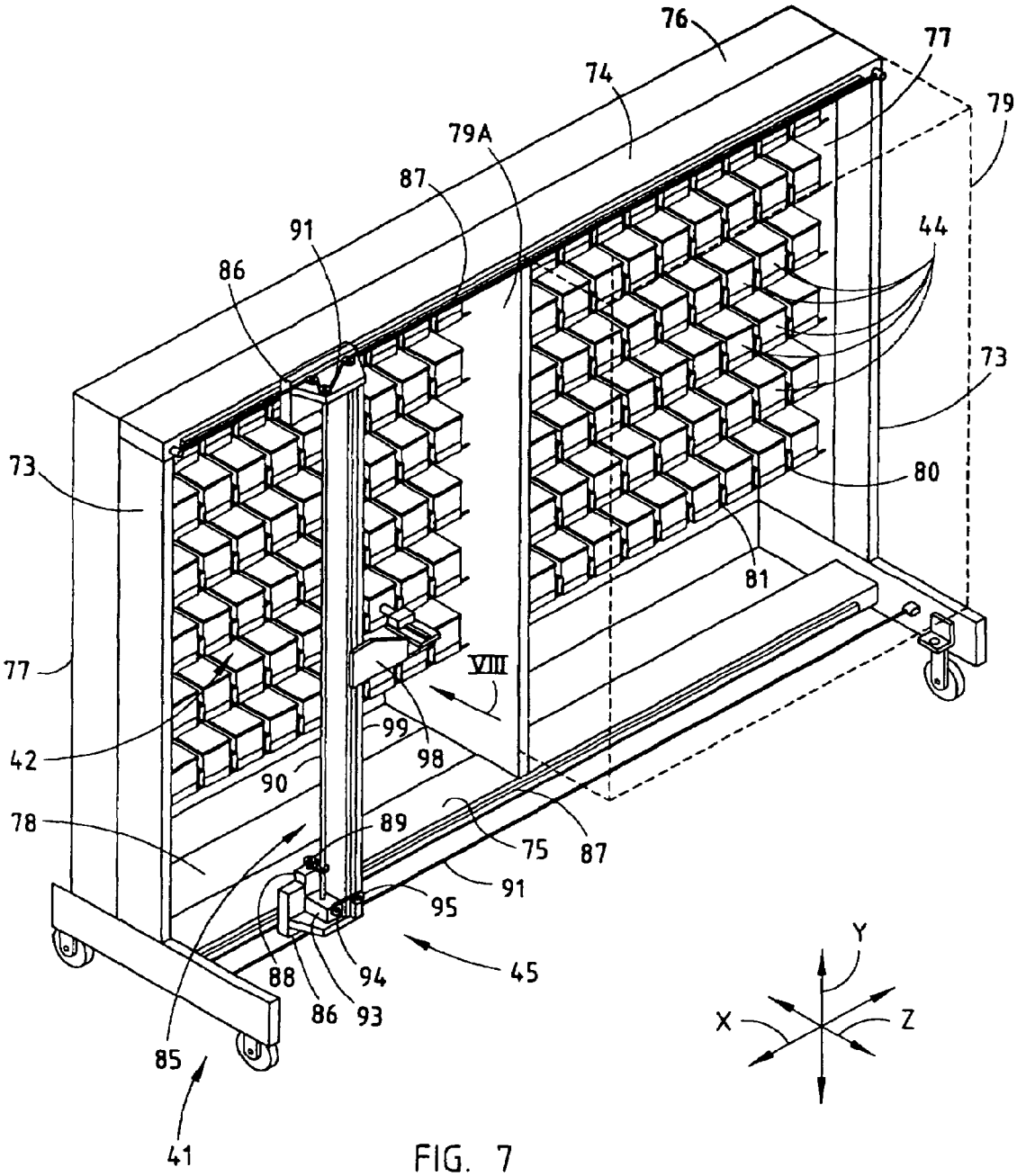
FIG. 7 is a perspective view of the front half of the storage area including storage units stored in the storage area and including the wheeled frame shown in FIG. 2.

A plurality of rods 80 are supported at their ends by side panels 77 and at a middle by an intermediate panel 79A, and L-shaped rod-supporting brackets 81 on the front panel 76 extend forwardly and support a length of the rods 80. A thin shelf panel 82 (FIG. 2) rests on each row of the rods 80 and brackets 81. The rods 80, brackets 81, and shelf panels 82 define a plurality of storage locations shaped to receive the storage units 44. Preferably, the rods 80, brackets 81, and shelf panels 82 are relatively thin to take up a minimum of space. Notably, FIG. 7 illustrates the front array 42. The rear array 43 is removed from FIG. 7, but is shown in the top view of FIG. 4. The illustrated tear array 43 is shown to be smaller than the front array 42, and is six rows high and ten columns wide, while the front array 42 includes six rows high and twenty-two columns wide. This provides one hundred ninety two storage locations for the storage units 44. Nonetheless, it will be clear to a person skilled in this art that the number of rows and columns can be increased to meet specific spacial requirements.

The x-y-z retriever module 45 (FIG. 4) is positioned in the aisle 46, and is operable to retrieve (and replace) any one of the storage units 44 in any the storage locations. It is noted that x-y-z retrievers are available commercially, and that different retrievers can be used successfully in the present apparatus 40, and further that such retrievers can be purchased from a company such as Animatics Company. The illustrated retriever module 45 (FIG. 7) includes a high-rise beam-type frame 85 slidably mounted by top and bottom blocks 86 for horizontal movement in an "x" direction along top and bottom tracks 87 on the horizontal frame members 74 and 75. A servomotor or actuator 88 (or reversible DC motor or reversible step motor or the like) includes top and bottom pulleys 89 connected by a shaft 90. The pulleys 89 engage top and bottom belts 91. The belts 91 extend along the top and bottom tracks 87, and are anchored at each end to side frame members 73. As the motor 89 rotates pulleys 90, the high-rise frame 85 moves horizontally to a selected position, with the top and bottom belts 91 acting together to maintain a vertical orientation of the high-rise frame 85. A second reversible servomotor or actuator 93 is mounted to the bottom block 86 and includes a drive pulley 94. Top and bottom driven pulleys 95 are operably mounted on the high-rise frame 85, and a belt extends between the two driven pulleys 95. The drive pulley 94 is connected to the bottom pulley 95 with a drive belt. A carrier 98 is slidably attached to the high-rise frame 85 for vertical movement in a direction "y" along a track 99 on the high-rise frame 85. When the motor 93 is operated, the carrier is moved vertically to a selected height position.

Figure 8:
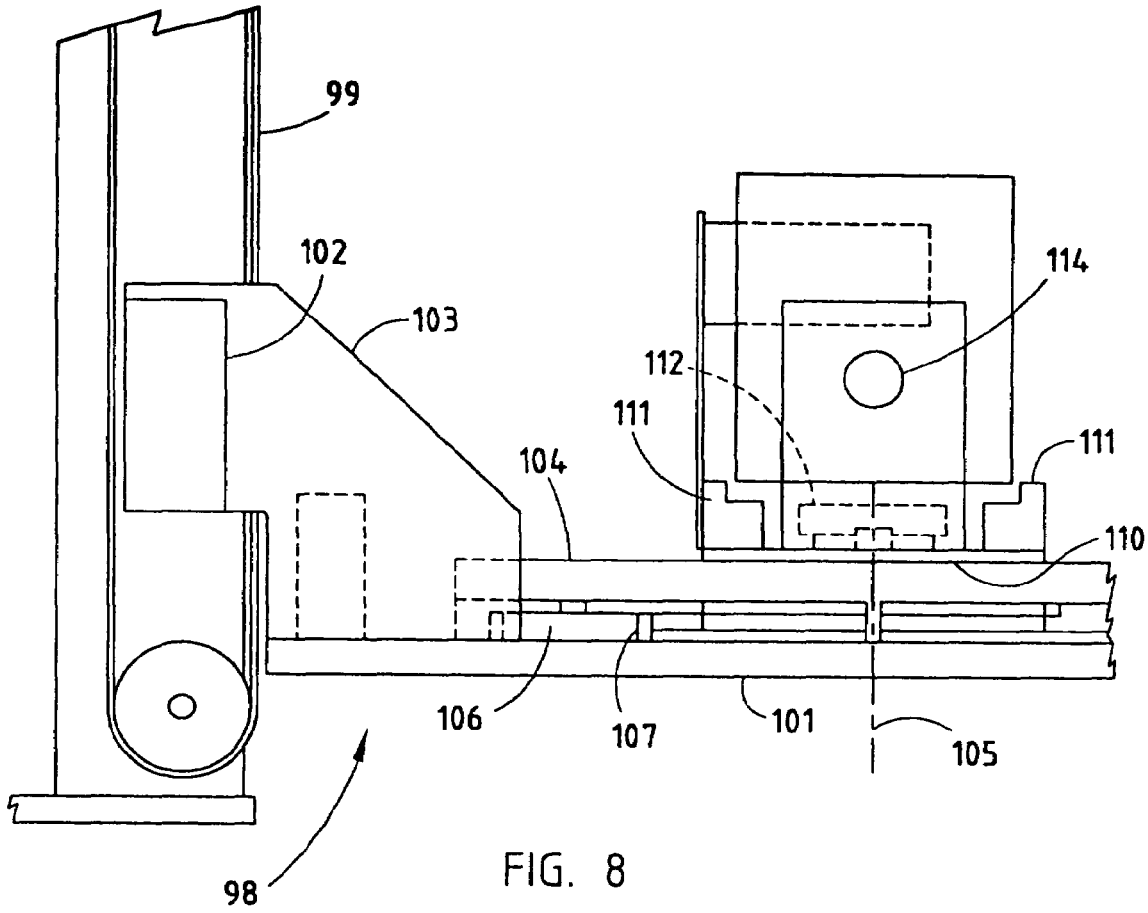
FIGS. 8-9 are front and top views of the retriever module shown in FIG. 7.
Figure 9:
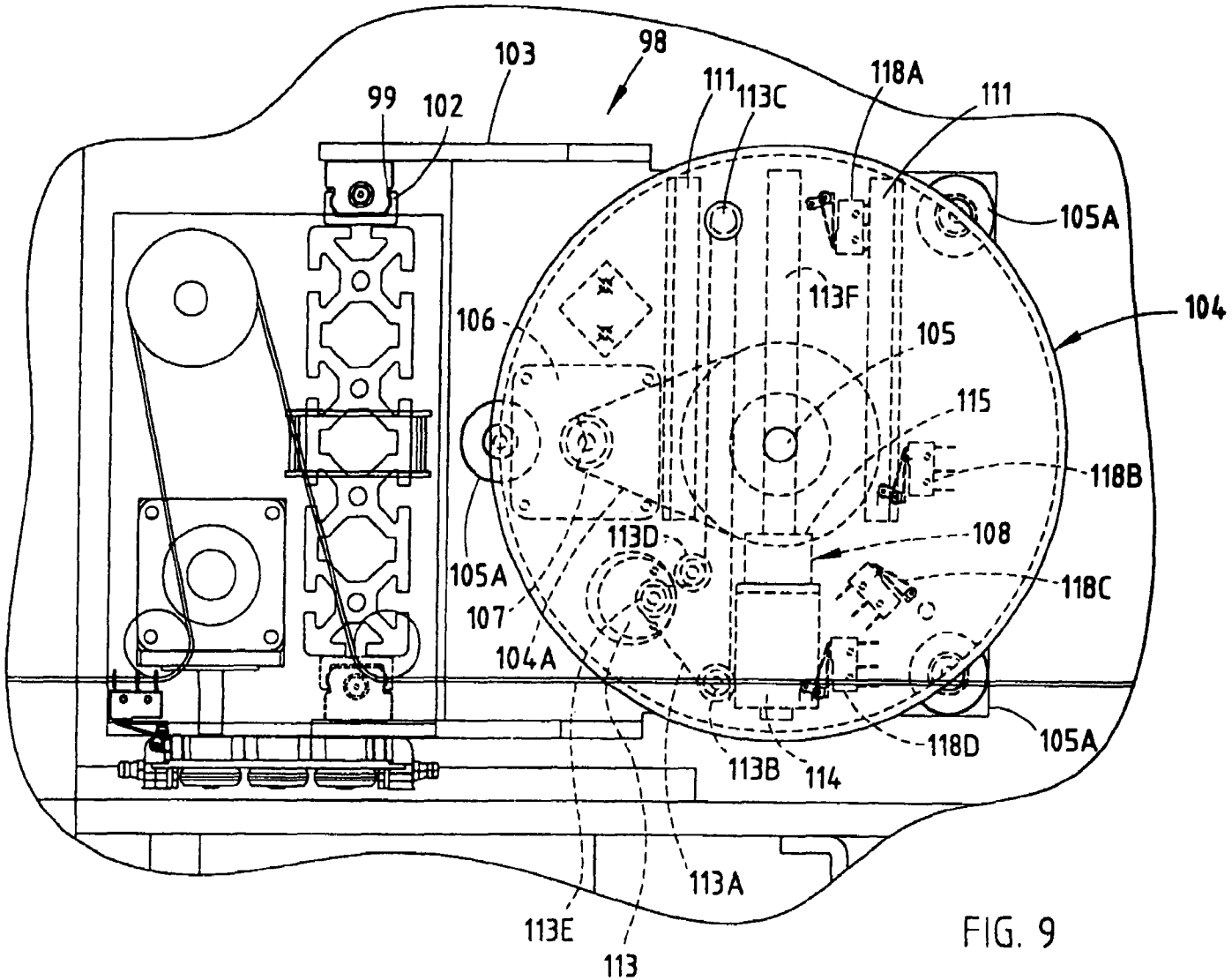
Figure 11:
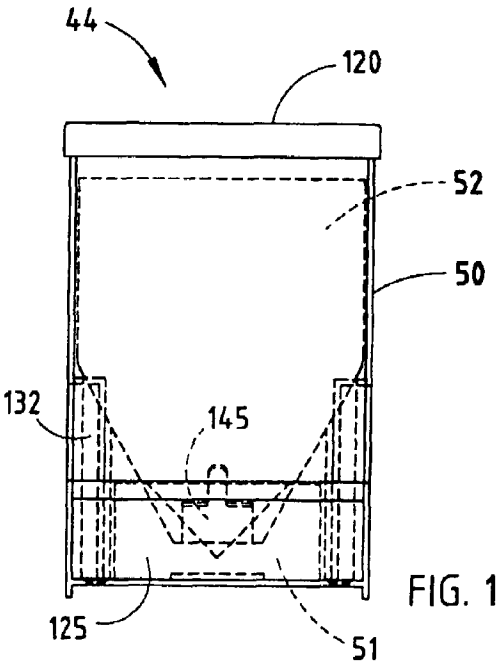
FIGS. 10-12 are side, front, and top views of the storage unit shown in FIG. 7.
Figure 10:
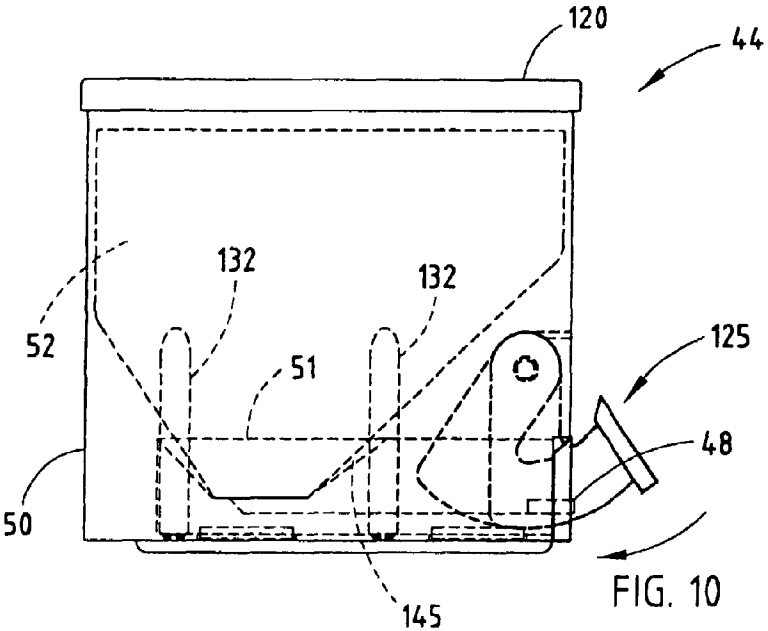

The carrier 98 (FIG. 8) includes a laterally-extending base plate 101 attached to a linear bearing 102 by an "L" bracket 103. The bearing 102 slidably engages the track 99 for providing the vertical movement of the carrier 98 on the high-rise frame 85. The base plate 101 supports a turntable 104 for rotation about a vertical axis 105 (FIG. 9), and a third servomotor or actuator 106 includes a rotatable wheel 107 operably connected to the turntable 104 by a belt 104A so that, upon rotation of the wheel 107, the turntable 104 is rotated to face the retrieving device 108 in front or rear directions (i.e., for grabbing storage units 44 in the front or rear arrays 42 and 43). Edge rollers 105 stabilize the turntable 105A. Attached atop the turntable 104 is an adapter 110 (FIG. 8) that carries a pair of L-shaped tracks 111 and optionally a center magnet 112. The retrieving device 108 includes a fourth servomotor or actuator 113 for extending a rod or slider 114. On the outer end of the slider 114 is an electromagnet 115 (hereafter called the "gripper" or "magnetic coupler") that can be energized to electrically magnetically couple to and attach to a metal washer 116 (FIG. 12A) on the end of the storage unit 44. The slider 114 is extended by rotating actuator 113, which causes a belt 113A that extends around pulley 113B-E to pull the slider along track 113F. When extended, the electromagnet 115 abuts and magnetically attaches to the washer 116 on a selected storage unit 44. The slider 114 is then retracted by the actuator 113, pulling the storage unit 44 onto the tracks 111. The center magnet 112 is optionally energized after the storage unit 44 is fully on the carrier 98 during transport of the storage unit 44 to the pill-dispensing module 47 for increased stability of the storage unit 44 during transport. Microswitches 118A-118D (FIG. 9) are provided on the turntable 104 to assure that the selected storage unit 44 is fully on the tracks 111 (or fully off the tracks 111) before the retriever is allowed to move to another location or to the pill-dispensing module 47.

Figure 6:
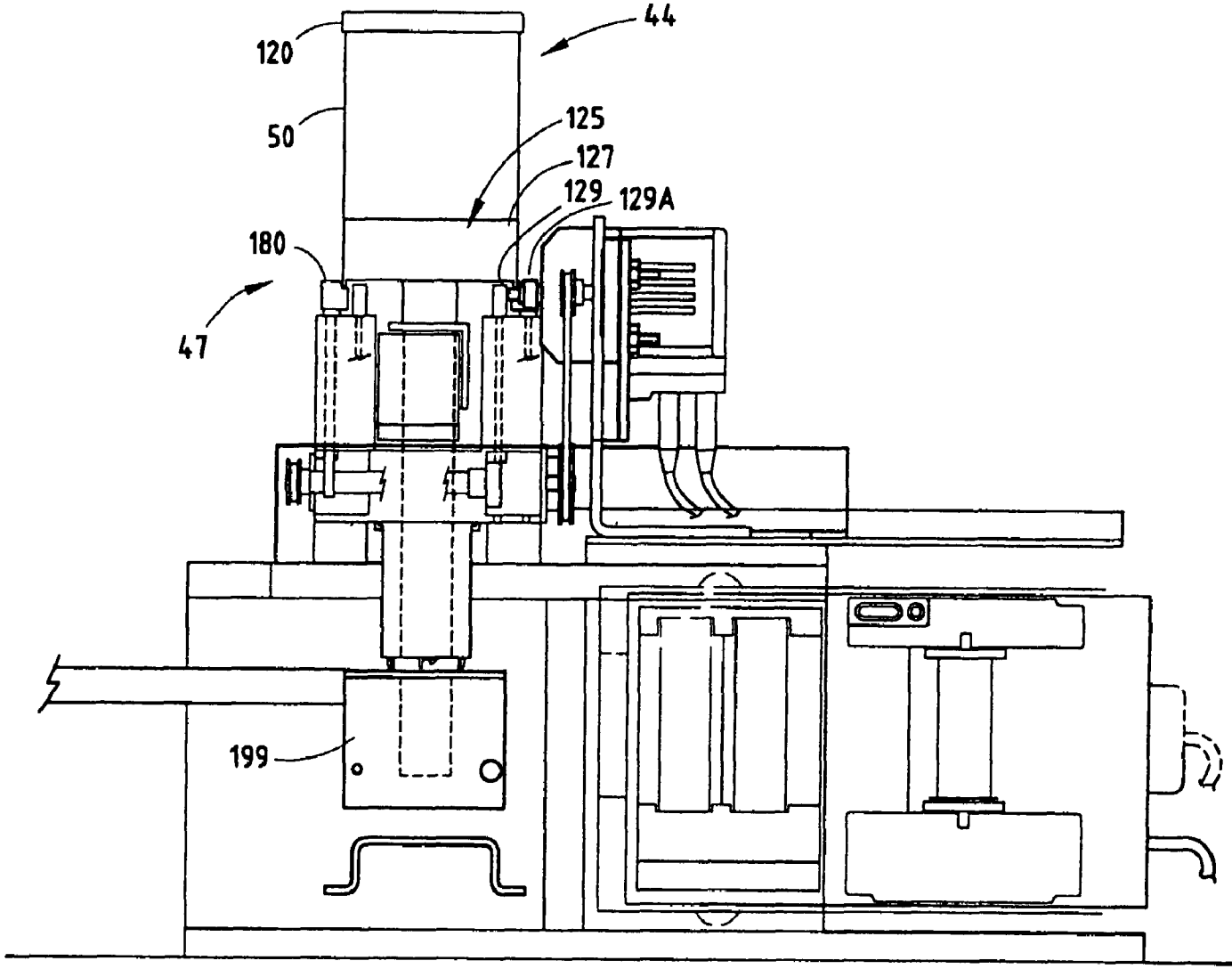
FIG. 6 is an enlarged partial view of a center upper portion of FIG. 3.

A database of the location of storage units 44 and their storage location is kept in the memory of the computer 57 and/or the controller 57C. Using the computer 57/controller 57C to monitor and sequence the cycle of the modules 88, 93, 106 and 113, along with magnets 112 and 115, different storage units 44 (i.e., different pills) can be selected and transported to the pill-dispensing module 47, as described below:

The storage units 44 (FIG. 12A) each include a generally rectangular outer container 50, a track 51 positioned in a bottom of the outer container 50, and a hopper 52 movably positioned within the outer container 50 for vertical movement toward and away from the track 51, for reasons described below. The container 50 includes flat side, front, rear and bottom walls forming a box-like shape. A top cover 120 removably snap-attaches to detents 121 along a top edge of the side, front, and rear walls of the container 50. The top cover 120 includes a lip 120A that overlaps the top edge of the container 50 to create a sealed dust-free environment for holding pills in bulk quantities. The container 50 includes a rectangular front opening 122, and a recess 123 on each side with pivot holes 124 therein. A door 125 (also called a "gate" herein) is pivotally attached to pivot holes 124, and includes a flat panel 126 shaped to completely cover the opening 122. The door 125 is spring-biased closed. Side edges 127 of the panel 126 extend slightly outward from the recess 123, creating an exposed tab that can be engaged by an offset actuator pin 129 on a servo-motor or actuator 129A (FIG. 6) at the pill-dispensing module 47 for opening the door 125 to allow pills 48 to drop from the track 51 out of the container 50.

An important aspect of the door 125 is that, when the door 125 is in a near-closed position, the flat panel 126 swings in a direction 127A substantially parallel to the groove in the track 51. This causes any pills 48 that are hanging on an edge of the track 51, ones which are ready to fall but that have not yet quite fallen, to be pushed back onto the track 51. This avoids many of the problems in the prior art caused by pills hanging on an edge of their tracks or pill feeding system. Specifically, in the prior art, these "hanging" pills often drop after the operation of counting pills has stopped (resulting in "extra" pills being dispensed, and, in effect, given away for free). Alternatively, these "hanging" pills potentially could drop as the bulk storage unit is being transported away, or get caught in a door such that they hold the door partially open. Further, some doors may crush the "hanging" pills, causing debris problems, sanitation or cross-mixing problems, and other related problems. The present apparatus solves this problem by pushing any "hanging" pills back onto the track 51, so that the "hanging" pill is held within the container 50 in a sanitary and sealed environment. In the fully closed position, the flat panel 126 fits into notches 128 in the side walls so that it aligns with the front wall of the container 50.

Figure 15:
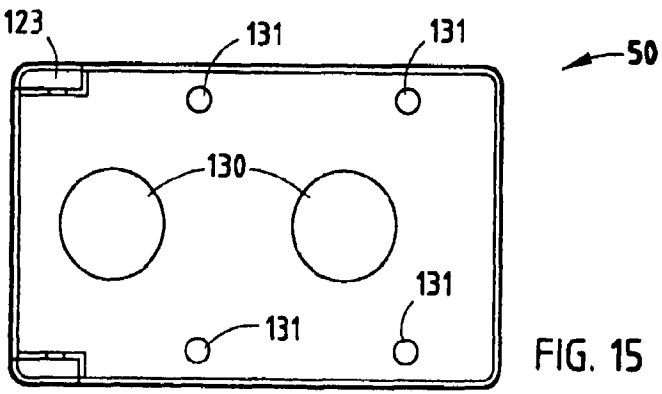

The bottom of the container 50 (FIG. 15) further includes two large holes 130 that align with the magnets on the vibrator 53, as described below. The bottom also includes four smaller holes 131 aligned with the stand-off legs 132 on the hopper 52, for reasons also described below.

The hopper 52 (FIG. 12A) is shaped to fit slidably within the container 50. Specifically, the hopper 52 includes an upper portion with flat side, front, and rear walls 134-137 forming a rectangular ring shape that fits closely within the walls of container 50. The close fit prevents pills from slipping between the walls of the hopper 52 and the walls of the container 50, but allows friction-free vertical sliding movement of the hopper 52 within the container 50. The lower portion of the hopper 52 includes inwardly angled side, front, and rear walls 138-141. The angled walls 138-141 define an opening 142 at their lower end. The angle of the angle rear wall 141 is greater than the other walls 138-140, such that the opening 142 is located at an upstream end of the track 51. Two stand-off legs 132 extend downwardly from each of the angled side walls 138 at locations aligned with the small holes 131 in the bottom of the container 50. The ends of the legs 132 are chamfered so that they extend partially into the small holes 131, but the legs 132 are of sufficient diameter so that the legs 132 do not fit through the holes 131. Notably, the hopper 52 "floats" within the container 50, which reduces the magnitude and sharpness of vibratory forces on pills 48. This is very beneficial because less damage, dust, and debris result from handling pills 48, thus maintaining a cleaner environment.

Figure 17A:
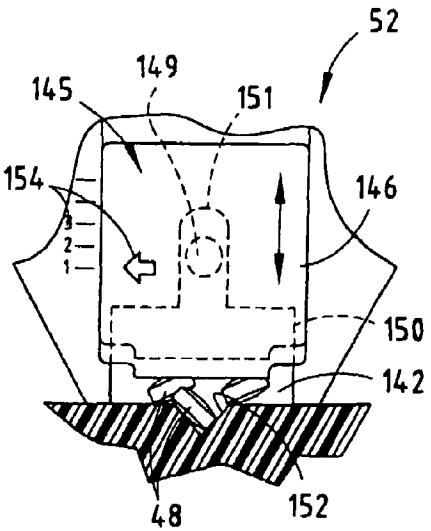
FIG. 17A is an enlarged fragmentary view of the gated opening of the hopper shown in FIG. 12A.
Figure 19A:
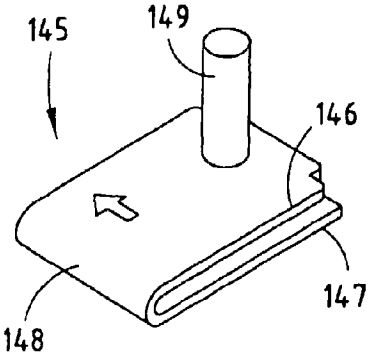
FIGS. 19-19A are perspective and side views of the adjustable gate component shown in FIG. 17A.
Figure 17:
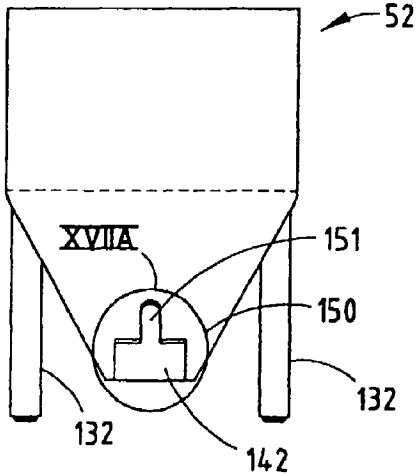
FIGS. 16-18 are side, front, and top views of the internal hopper shown in FIG. 12A.
Figure 19:
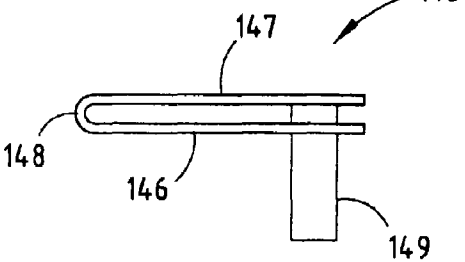
Figure 16:
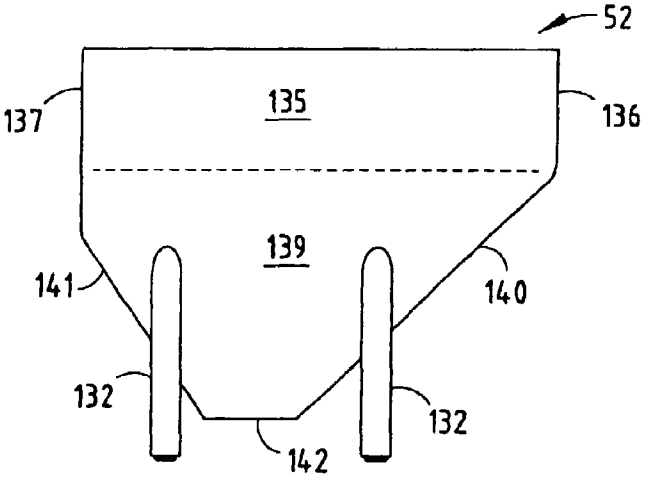
Figure 18:
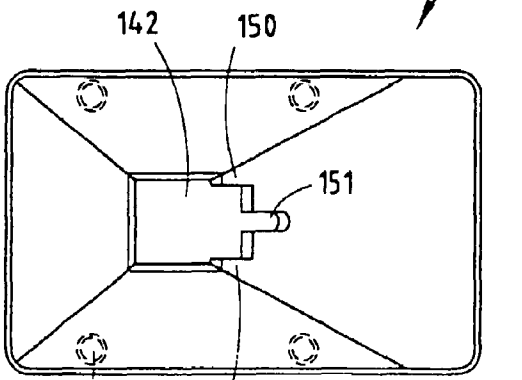
Figure 20A:
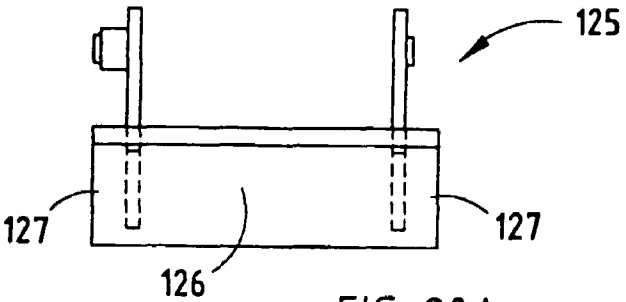
FIGS. 20-20A are side and front views of the door shown in FIG. 12A.
Figure 22:
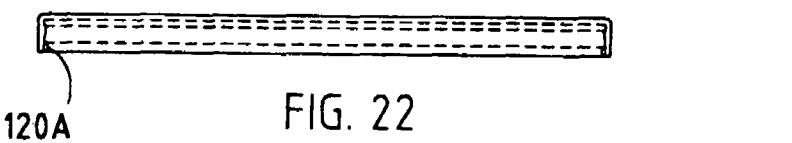
FIGS. 21-22 are top and side views of the top cover shown in FIG. 12A.
Figure 20:
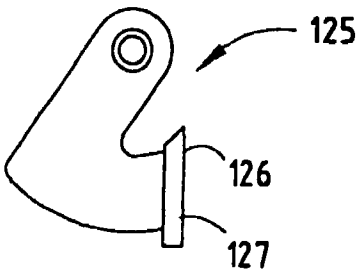
Figure 21:
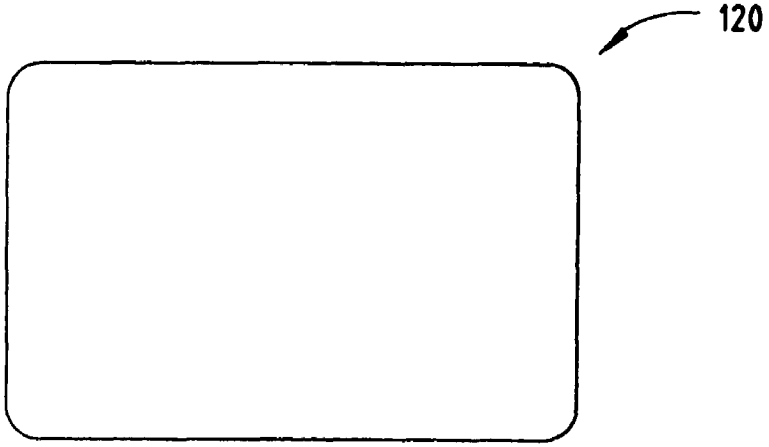
Figure 24:
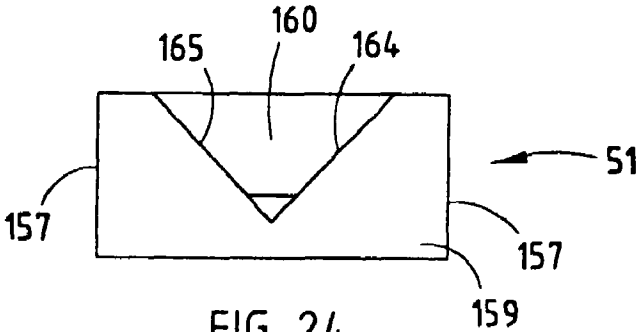
FIGS. 23-27 are perspective, front, side, top, and bottom views of the pill track shown in FIG. 12A.
Figure 25:
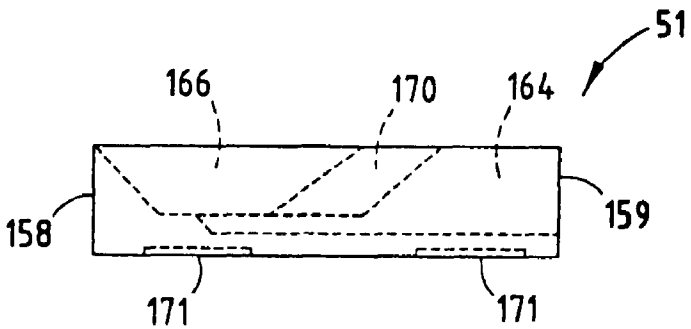

An adjustable gate 145 (FIG. 19-20) includes opposing tabs 146 and 147 attached together by a bend 148, and further includes a perpendicular pin 149 that extends through the tabs 146 and 147. The tabs 146 and 147 frictionally but slidably engage the marginal material 150 on the angled wall 141 that defines the opening 142. The pin 149 also engages a slot 151 that is also defined by the marginal material 150. The pin 149 stabilizes the gate 145 by engaging slot 151, and also it acts as a handle to facilitate adjustment of the gate 145. The gate 145 is adjustable toward and/or away from the track 51, to increase or decrease a size of the opening 142. Notably, perhaps more important than the size of the opening 142, is a size of the gap 152 under the gate 145 to the track 51. The gap 152 can best be seen in FIG. 17A. Notably, pills 48 pill up in the "upstream" end of the track 51 below the opening 142 and behind the gate 145, and the pills 48 must travel under the gate 145 (i.e., through the gap 152) as the pills 48 travel along the track toward the drop point at the downstream end of the track 51. As shown by FIG. 17A, considerably more pills 48 will travel through the gap 152 and under the gate 145 when the gate is adjusted upwardly.

It is noted that in some prior art systems, separate pieces defining different sizes and shapes of "gaps" were sold by factories, in order to optimize pill-dispensing systems. However, this resulted in a myriad of additional special-order custom-built parts and pieces. While this may be beneficial to the manufacturer of the pill-dispensing equipment due to increased reordering of specialty parts and pieces, it caused a major problem for users, since the users "never" seemed to have the right mix of parts that they needed. As a result, they continually had to order new and different parts and pieces from the manufacturer, and it added considerably to cost and maintenance problems. The present adjustable gate 145 is very simple and easy to adjust, simple to use, intuitively logical in its adjustment and flexibility of use, and easy to replace. Further, it uses a single adjustable gate and simple attachment mechanism. By placing indicia 154 (FIG. 17A) along the slot 151, the factory can still suggest optimal gate settings and gap sizes for particular drugs. Thus, recommended initial settings can be quickly and easily made.

Figure 23:
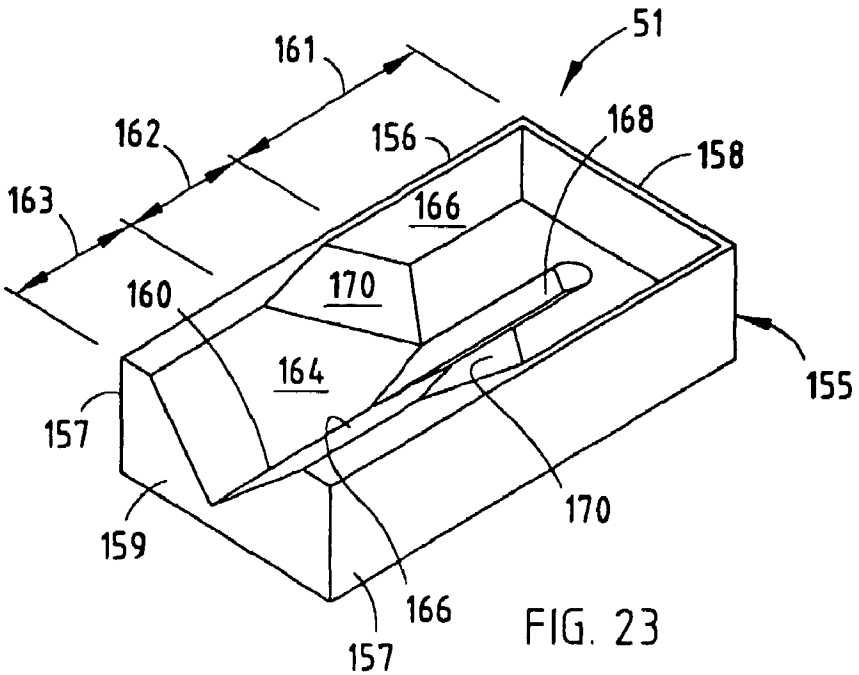
Figure 26D:
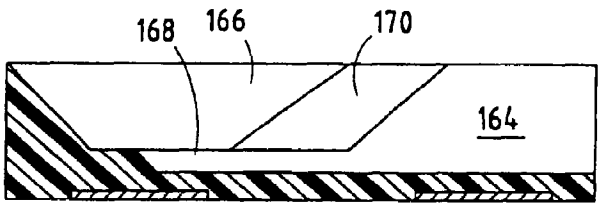
FIGS. 26A-26D are cross-sectional views taken along the lines 26A-26A, 26B-26B, 26C-26C, and 26D-26D in FIG. 26.
Figure 26:
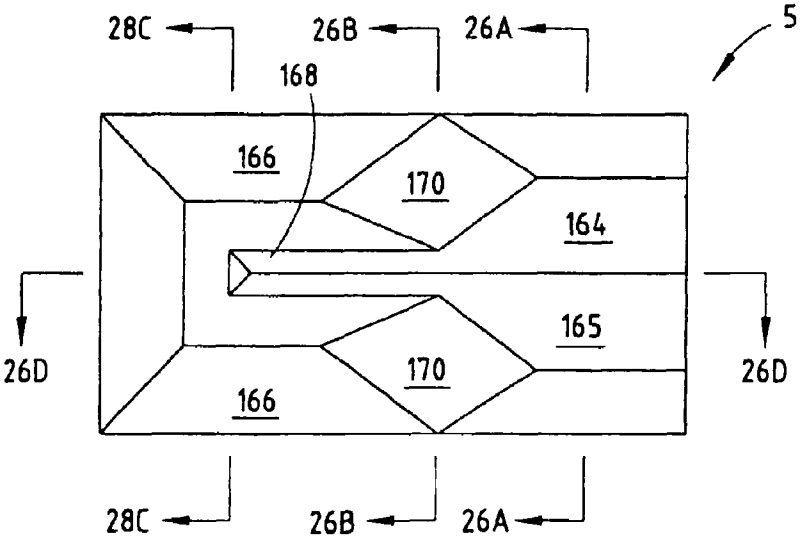
Figure 26C:
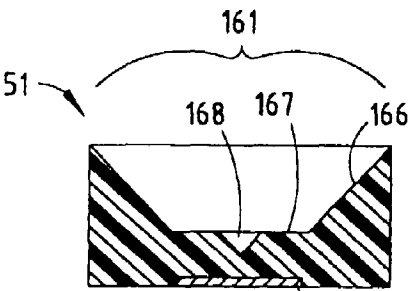
Figure 26B:
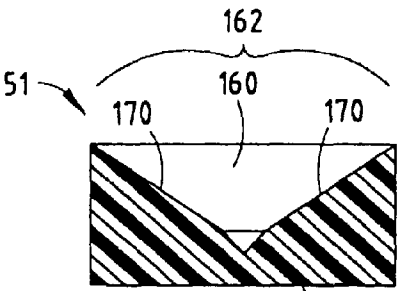
Figure 26A:
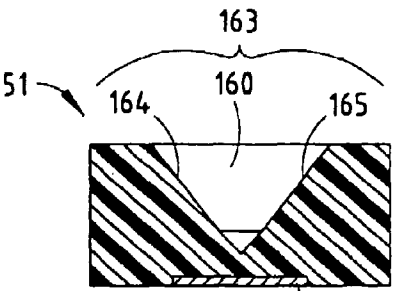
Figure 32:
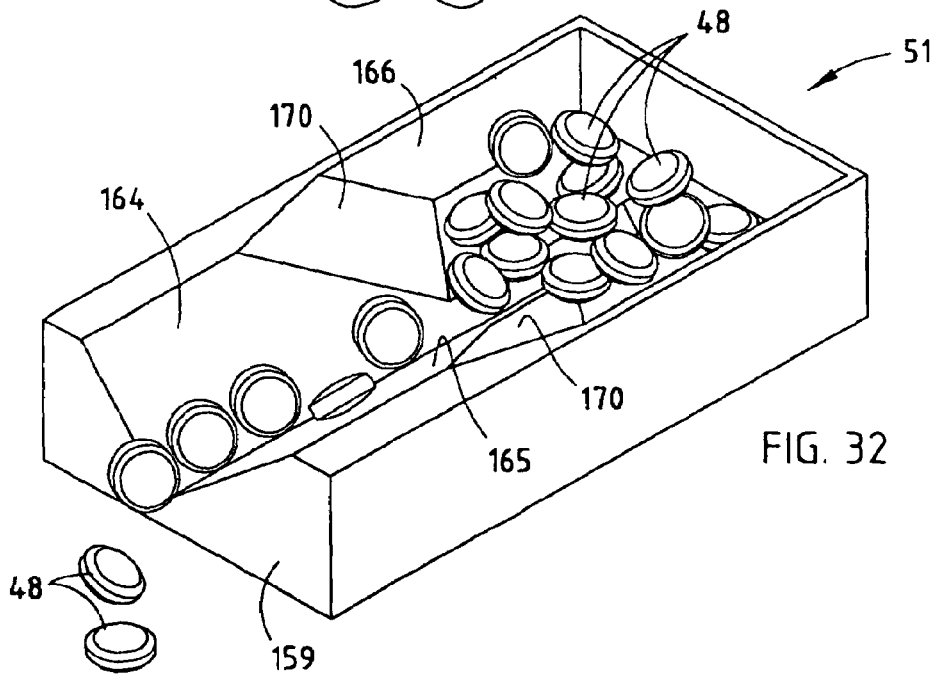
FIG. 32 is a perspective view showing pills positioned on the track and bunched up at the transition area where the pills are redistributed on the track to help distribution and singulation of the pills.

As noted above, the track 51 (FIG. 10-12A) is adapted to be positioned on a bottom of the outer container 50. The track 51 (FIGS. 23) is designed to be useful for feeding solid pills 48 along its length upon vibration of the track 51. The track 51 is made of a solid polymeric block member 155 having a top surface 156 defining a generally horizontal plane. The side surfaces 157 of the block member 155 are shaped to fit between the stand-off legs 132, with a rear wall 158 resting adjacent the rear wall of the container 50, and a front edge 159 positioned under the front wall of the container 50 and close to but inside the door 125. A groove 160 is formed in the block member 155 that extends from an upstream end 161 of the solid member 155 across a middle section 162 of the solid member 155 to a downstream end 163 of the solid member 155. The groove 160 further extends to the front edge 159 of the solid member 155 at the downstream end 163. The groove 160 in the downstream end 163 (FIG. 26A) defines a well-defined "V" shape with first angled side surfaces 164 and 165 that extends at about 45 degrees to vertical, and that are adapted to convey singulated pills 48 (FIG. 32) to and off the front edge 159 one at a time. (See FIG. 32). The groove 160 in the upstream end 161 (FIG. 26C) defines an enlarged pocket with angled side surfaces 166 and a flat bottom 167 shaped to store pills. The pocket in the upstream end 161 is inclined toward the downstream end 163, and includes a small "V" groove 168 that leads to and is aligned with a bottom of the larger "V" groove 160, such that it is shaped to slidingly convey pills 48 dropped out of the hopper 52 onto the upstream end 161 toward a center of the upstream end 161 and into the small groove 168. The portion of the groove 160 in the middle section 162 is formed from compound-angled side surfaces 170 that are diamond shaped (in top view, see FIG. 26). The angled surfaces 170 extend at a vertical angle greater than 45 degrees (compare FIG. 26B to FIG. 26A) and extend at compound angles to the first and second angled side surfaces 164-166 to form a transition pocket. The transition pocket acts as a "speed bump" to redistribute bunched-up pills 48 as the bunched-up pills 48 travel from the upstream end 161 into the middle section 162. By this arrangement, the transition pocket unbunches and breaks up bridging of the pills 48, and redistributes the pills 48. It is contemplated that a second "speed bump" may be included along groove 160 if a second redistribution of pills would help singulation. The surfaces 166 then center and singulate the pills 48 as the redistributed pills 48 travel out of the transition pocket in the middle section 162 toward the downstream end 163. It is noted that the groove 160 in the downstream end 163 is shaped to handle a variety of different shaped pills 48. In the illustrated arrangement, the pills 48 are disk-shaped, and can roll along either surface 164 or 165 (see FIG. 32), with their flat side resting on the other surface 164 or 165. Long pills travel well along this groove 160, and bridging is broken up in an efficient manner, based on preliminary testing.

Figure 27:
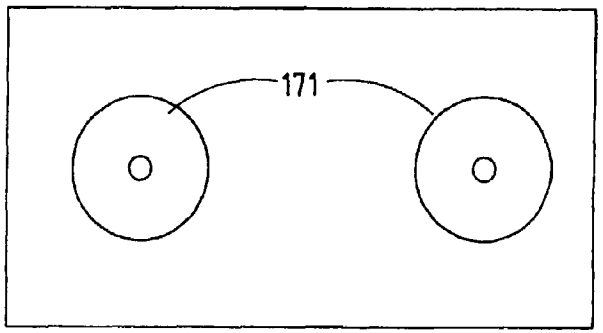

A bottom of the track 51 (FIG. 27) includes a pair of magnetically responsive metal pieces, such as iron or steel washers 171, that can be magnetically gripped by a magnet(s). Preferably, the washers 171 are inset into a bottom of the track 51 so that the track 51 provides a smooth flat bottom surface. One washer 171 is near a front end of the track 51, and the other washer 171 is near a rear end, which allows the vibration nodes 185 and 186 to provide an unbalanced vibration on the front or rear of the pill track 51.

The pill-dispensing module 47 (FIG. 33) is provided for unloading pills 48 into a vial 49. The pill-dispensing module 47 includes a docking station for receiving a selected storage unit 44, a pill counter 54 for counting pills 48 dispensed from the storage unit 44, and a lift 55 for lifting the hopper 52 to break bunched-up pills 48 during the pill-dispensing cycle. More specifically, the pill-dispensing module 47 includes a base plate 175, and a raised platform plate 176 spaced above the base plate 175, both mounted to the frame 41. For example, the base plate 175 can be mounted to the side frame member 73 and an intermediate vertical panel 79A (FIG. 7) at an intermediate height between the top and bottom beams 74 and 75. A docking station is formed on the platform 176 and includes a pair of spaced-apart stands 178 and 179. A pair of "L" tracks 180 and 181 (identical to the tracks 111 on the x-y-z retriever 45) are positioned on the stands 178 and 179. However, tracks 180 and 181 are fixed to vertical rods 182, which in turn are slidably mounted to the stands 178 and 179. An axle 183 extends through the stands 178 and 179, and an internal cam (not specifically shown) on the axle 183 is configured to raise and lower the tracks 180 and 181 as the axle 183 is turned. A pulley 184 on the end of the axle 183 is operably connected to an actuator or servomotor 185 for controlled rotation so that a height of the tracks 180 and 181 can be closely controlled. In their raised position, the tracks 180 and 181 align with the tracks 111 on the carrier 98 of the retriever 45. This allows the slider 114 to move a selected storage unit 44 from the tracks 111 onto the tracks 180 and 181.

Figure 28:
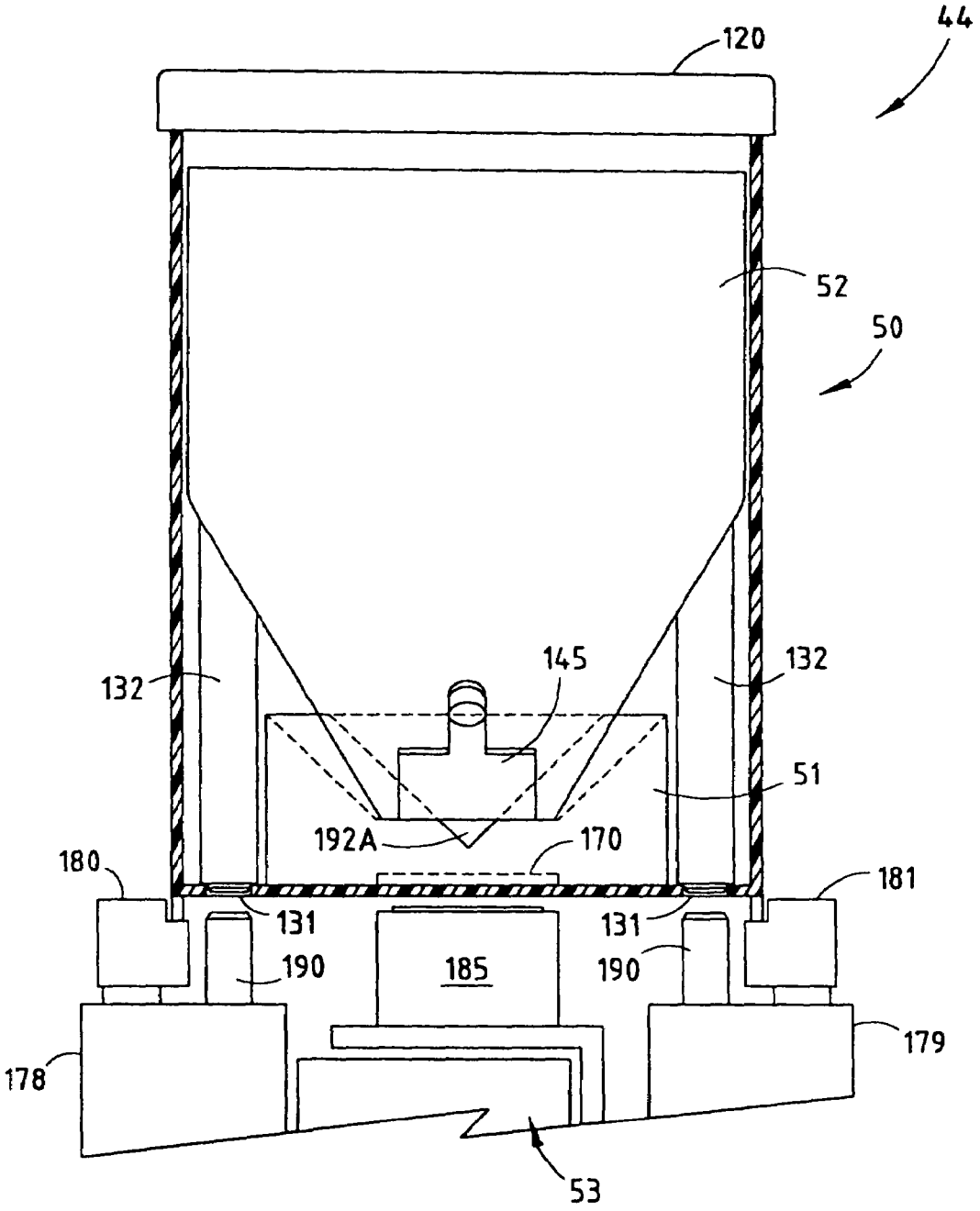
FIG. 28 is a front view, partially in section, showing a position of the outer container and inner hopper during loading of the storage unit onto the pill-dispensing module.
Figure 29:
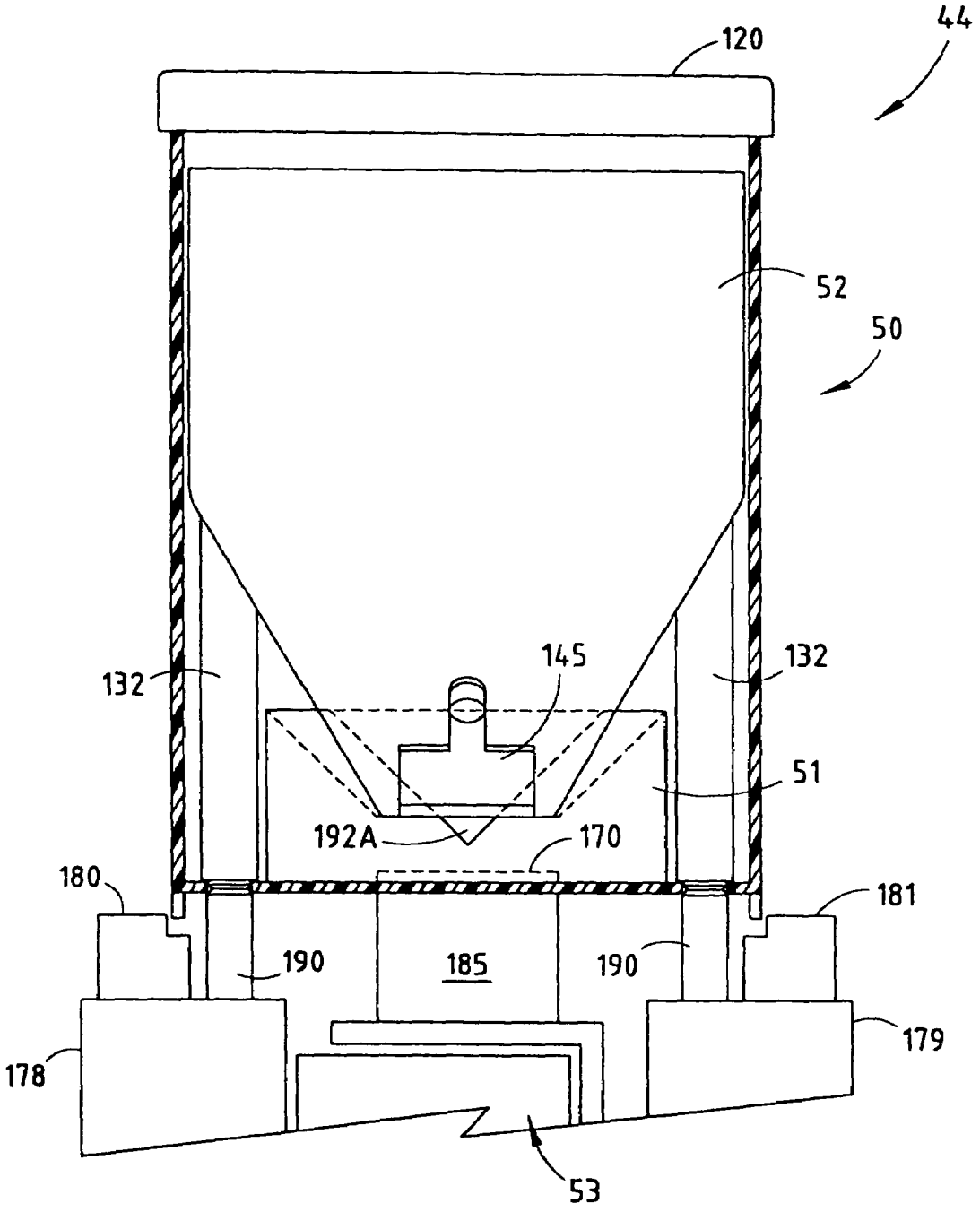
FIGS. 29-30 are similar to FIG. 28, but FIG. 29 shows the internal hopper lowered for starting a pill-dispensing sequence, with the gate being in a very restrictive small-gap position.

The vibrator device 53 (also called an "oscillator") is positioned between the tracks 180 and 181, and includes front and rear up-protruding vibratory nodes 185 and 186. The nodes 185 and 186 are positioned low enough such that the bottom wall of the container 50 slides over them when a selected storage unit 44 is being loaded into the docking station (i.e., when the tracks 180 and 181 are in the raised position—see FIG. 28). When the tracks 180 and 181 are lowered (see FIG. 29), the vibratory nodes 185 and 186 extend through the holes 130 in the bottom wall of the container 50 and touch and then magnetically couple to the washers 170 and 171 on a bottom of the pill track 51. This allows the vibratory device 53 to vibrate the pill track 51 without violating or contaminating the internal space within the container 50. By selectively vibrating one or both of the nodes 185 and/or 186, the flow of pills 48 along the pill track 51 can be closely controlled. The direction and amplitude of vibration of each node can be varied or controlled for optimal operation. For example, the front node 185 can be vibrated at about 7°, and the rear node 186 can be vibrated at about 10° from vertical.

Figure 30:
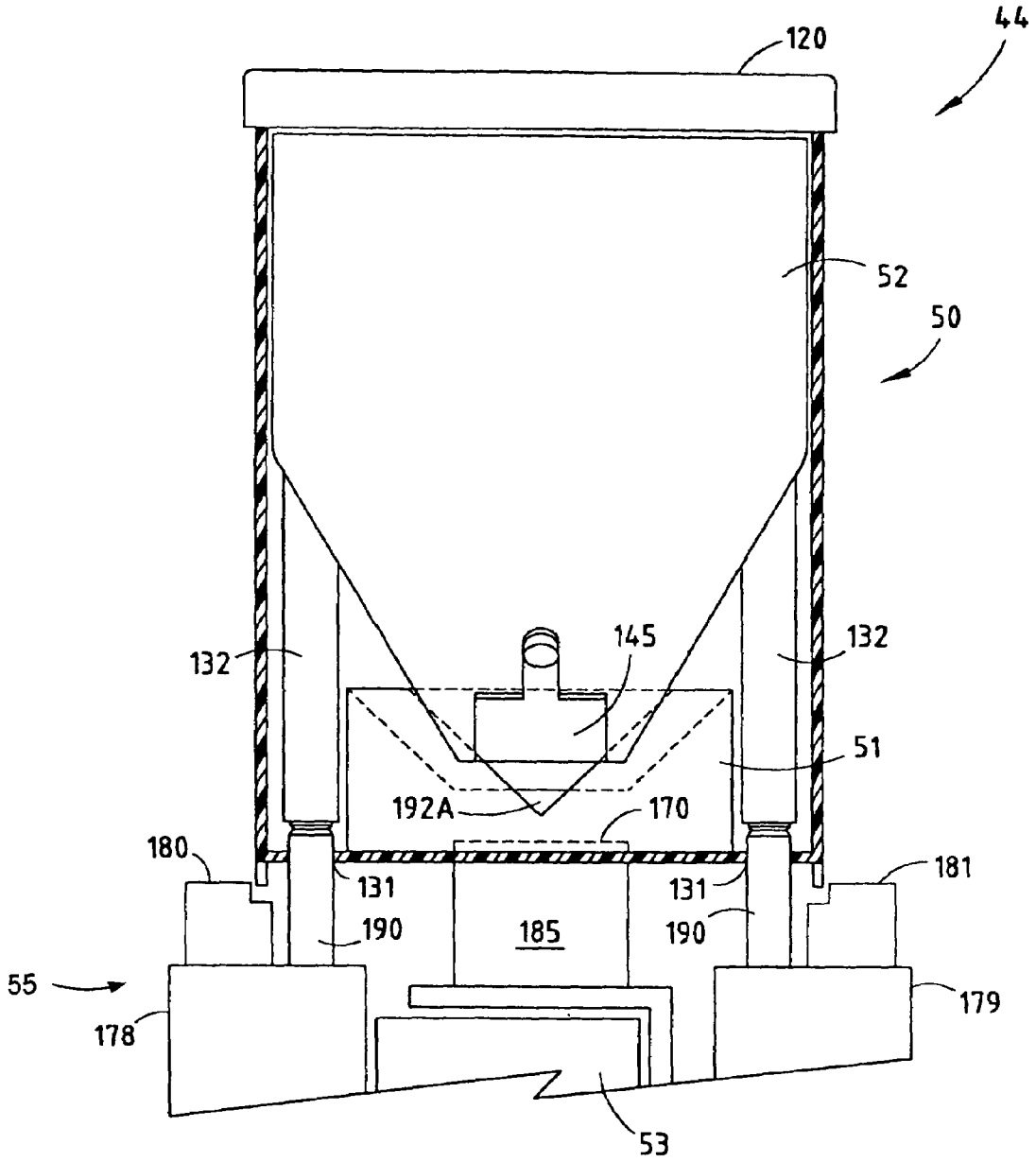
Figure 31:
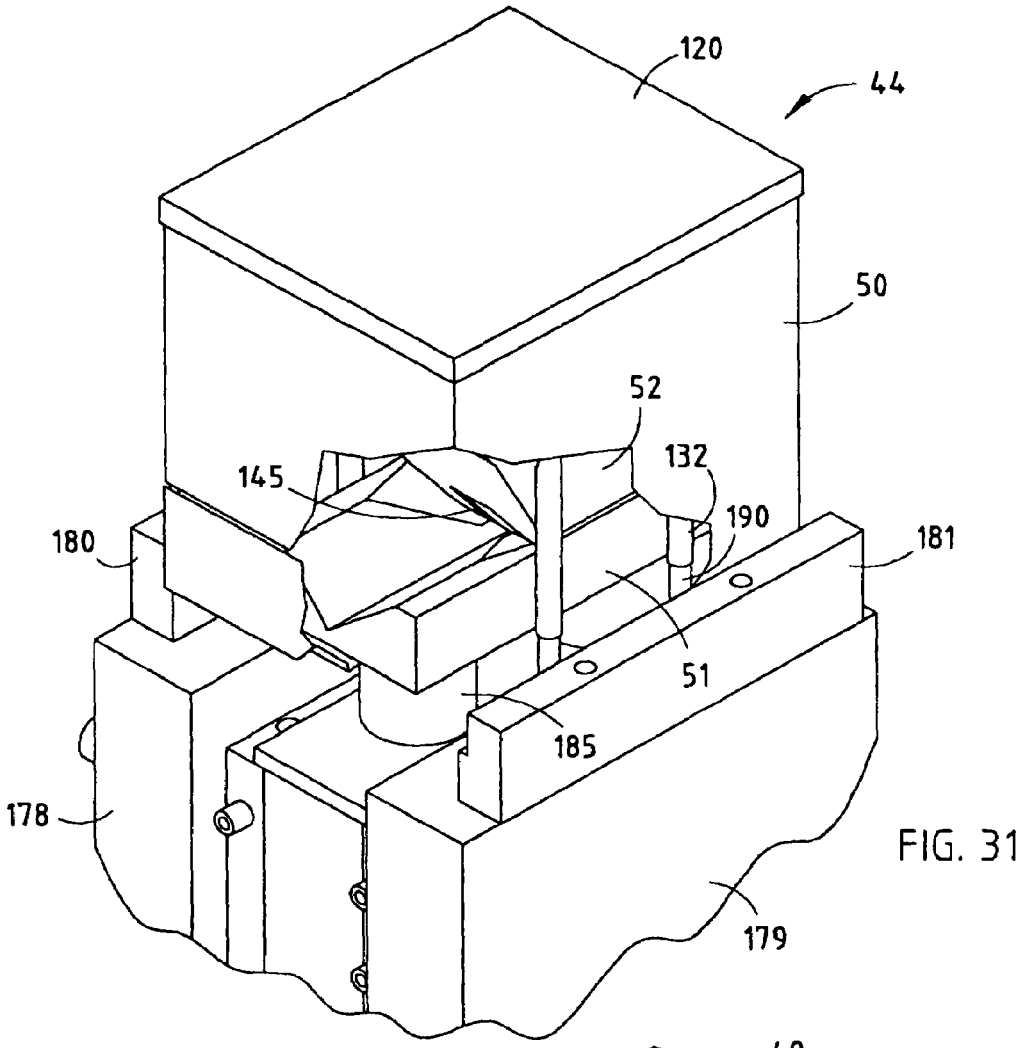
FIG. 31 is a perspective view, with the container partially broken away, to show the track and internal hopper ready to drop pills in the pill-dispensing module.

The lift 55 (FIG. 30) includes upright lift pins 190 that extend vertically through the stands 178 and 179. A second axle extends through the stands 178 and 179 parallel the axle 183 and is operated by a second actuator much like the axle 183. Specifically, the lift 55 includes a cam on the second axle that, when rotated, causes the pins 190 to telescopingly extend. When the lift pins 190 are lifted/extended, they extend through the holes 131 in the bottom wall of the container 50 and up against the ends of the stand-off legs 132, such that they cause the hopper 52 to raise within the container 50. (See FIG. 30, and compare FIG. 30 to FIG. 29. Also, compare the enlarged V-shaped gap 192 in FIG. 30 with the smaller gap shown in FIG. 29). It is noted that the slider 114 can also be operated to help motivate pills 48 along the pill track 51.

In the pill-dispensing module 47 (FIG. 33) pills 48 that drop off the front edge 159 of the pill track 51 fall through a funnel 195, through an optical pill counter 54, through a second funnel 197 into a vial 49 held in a vial holding station or nest 199A. Optical pill counters, such as the pill counter 54, are well known in the art such that a detailed description of them is not required. The illustrated counter 54 is attached in an aperture in the platform 176 in front of the stands 178 and 179. A roll of sticky labels 200 is routed through a printer 58 and into an applicator 58A. The applicator 58A pulls off the releasable paper from the sticky side of the label 200, and threads the printed label 201 toward that side surface of a rotating vial 49. The vial 49 is rotated by a spinner motor or actuator 203 that spins a roller 202 rotatably engaging the side surface of the vial 49. The roller 202 presses the printed label 201 into adhering contact with the side surface. A bar code reader 205 reads a bar code on the printed label 201 and a second bar code reader 205A reads a second bar code on the container 50 to assure that the correct pills 48 are being put into the vial 49.

Vial handling devices 59 are well known in the art such that a detailed description is not required. Accordingly, the discussion below is sufficient for an understanding of the present inventive concepts by persons skilled in the art.

Figure 5:
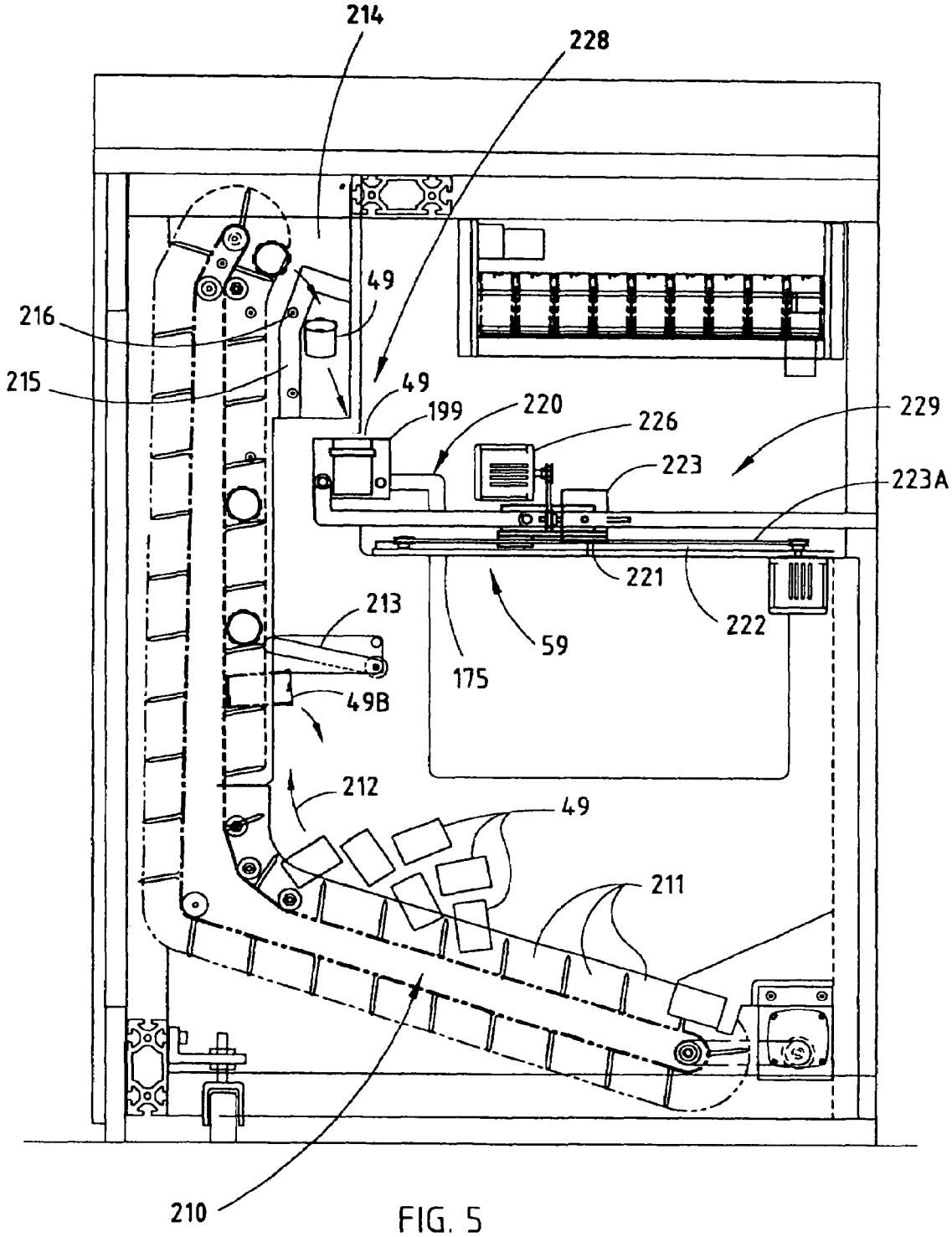
FIG. 5 is an enlarged partial view of the left-hand portion of FIG. 3.
Figure 34:
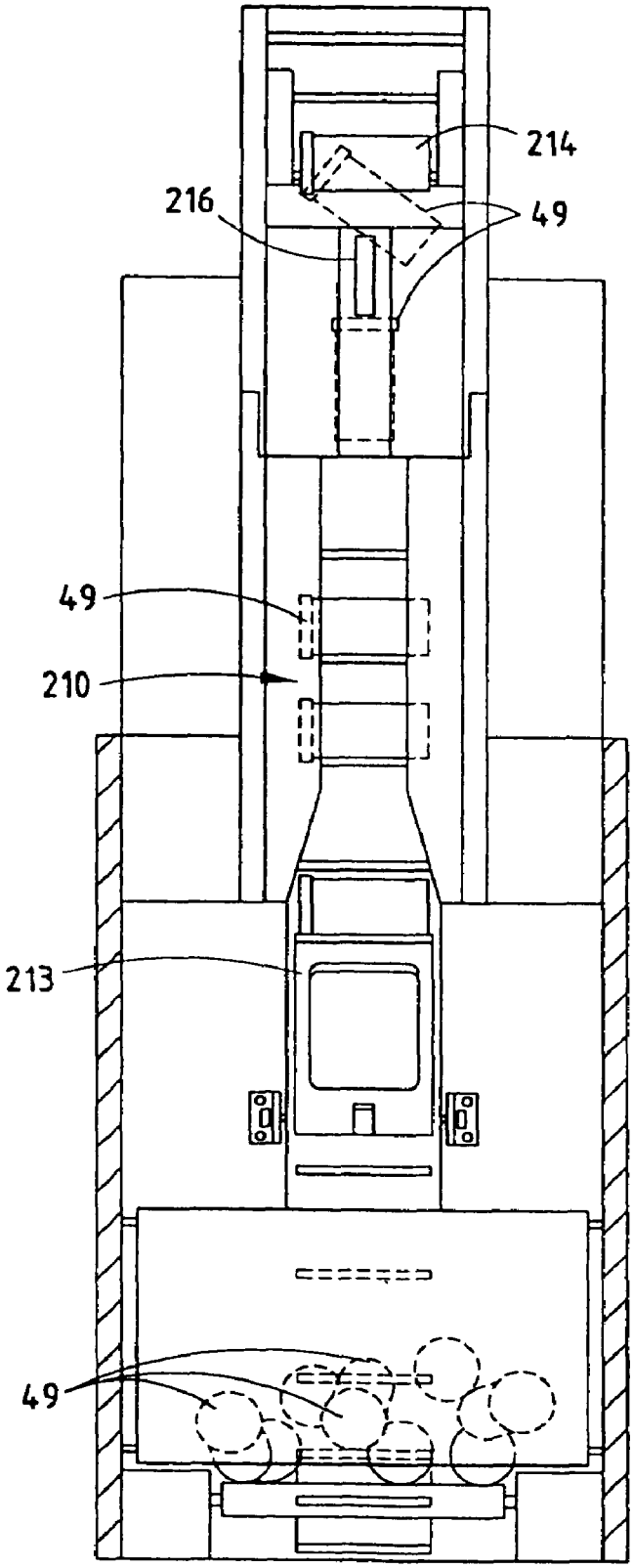
FIG. 34 is a side view of the vial bulk-handling apparatus.

The vial-handling device 59 (FIG. 5) includes a conveyor 210 with nests 211 shaped to hold vials 49. The conveyor 210 is motivated along the direction 212. Vials such as vial 49B that do not seat fully into the nests 211 are knocked off the conveyor 210 by a flapper 213. Vials 49 that successfully seat and are conveyed to a top of the conveyor 210 are unloaded at a vial loading station 214. The vial loading station 214 includes a tipper 215 that tips the vial 49 upright, so that the bottom of the vial 49 is down and the open end of the vial 49 is up. Different tippers are known in the art. The present tipper 215 includes a center protrusion or ridge 216 (FIG. 34) that engages a center of the vials 49 as they are bumped off the conveyor 210. The bottom of the vial 49 is heavier (since the top of the vials are open), such that the bottom naturally swings downwardly ahead of the top when the protrusion 216 drags on a side of the vial 49. Thus, the vial 49 is oriented as the vial 49 further drops into a cylindrical nest 199 (FIG. 5) of the vial handler module 220.

Figure 3:
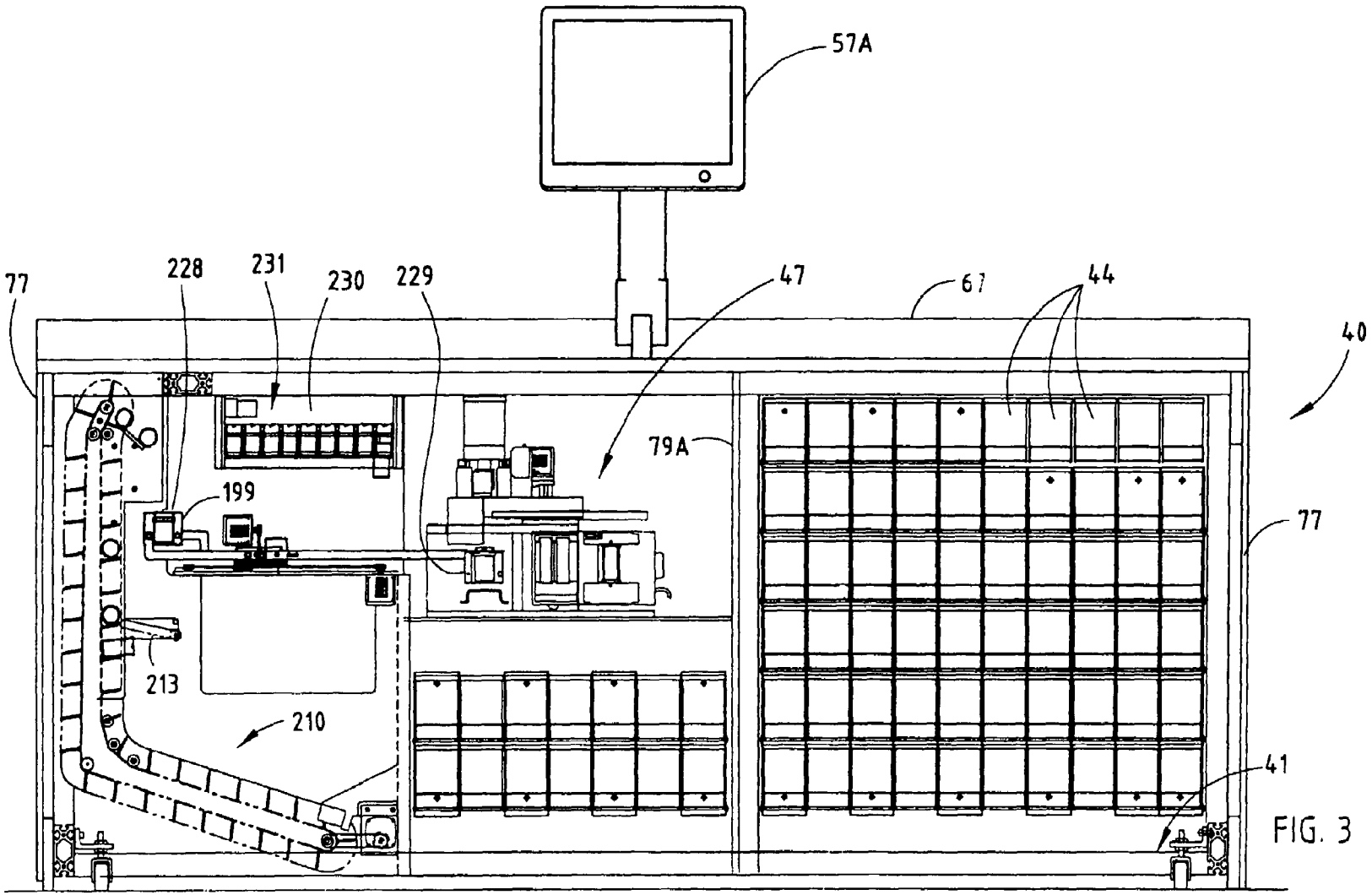
Figure 35:
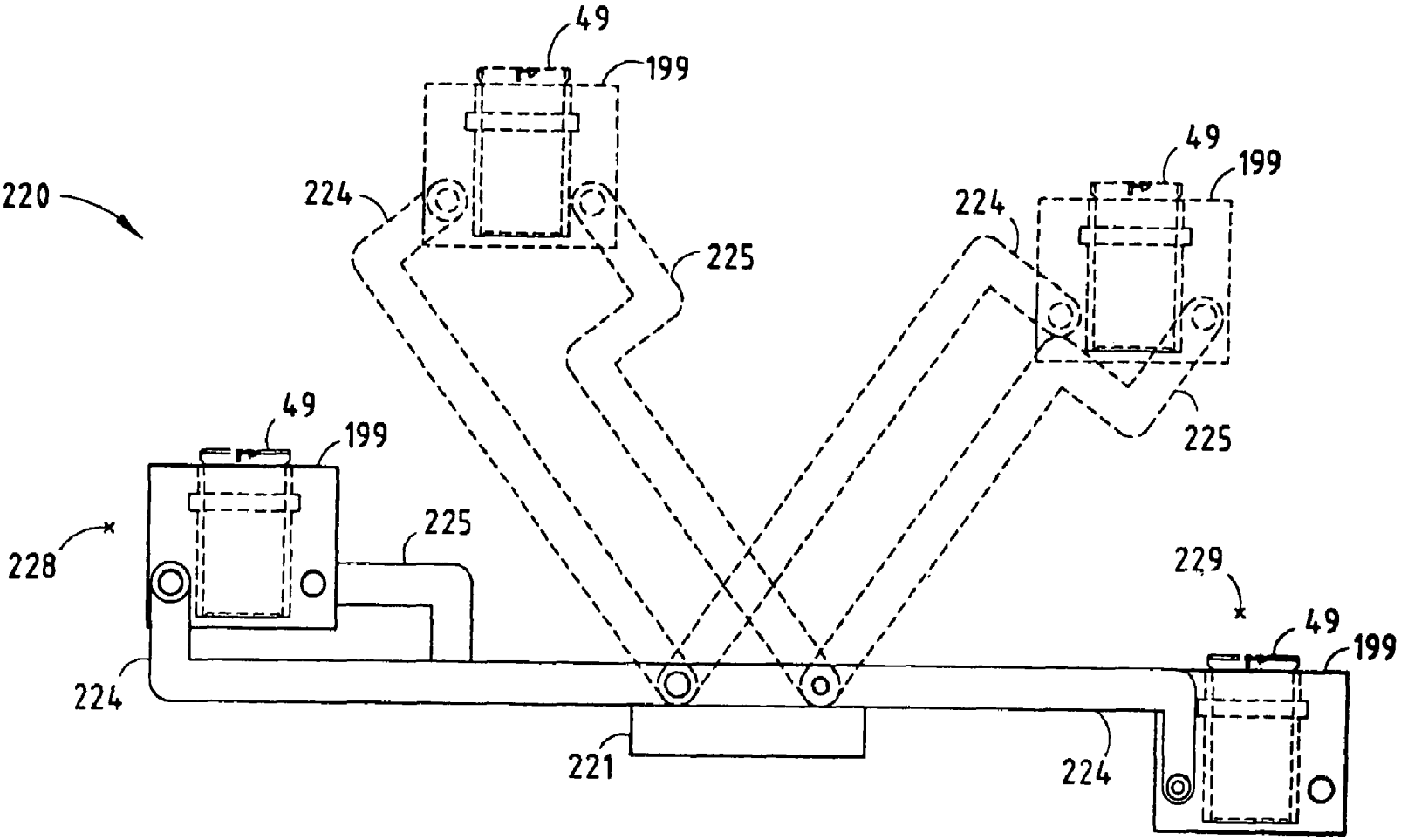
FIG. 35 is a side view showing different positions of the vial handler.

The vial handler module 220 (FIG. 5) includes a base slider 221 slidably mounted on a linear track 222 for lateral movement in the "x" direction previously defined. The track 222 is supported on the base plate 175 (or on another stationary mounting plate on the frame 41), and actuators 223 are operably mounted to the base plate 175 and are coupled to a band 223A for moving the base slider 221 along the track 222. The vial holder 199 (FIG. 35) is mounted to the base slider 221 by two pairs of arms 224 and 225 that work in a parallelogram arrangement to always keep the vial holder 199 level and facing upwardly. A second actuator 226 (FIG. 5) is operably attached to the arms 224 and 225 for pivoting them on the base slider 221 from a left position to a right position. Operation of the second actuator 226 causes the arms 224 and 225 to move the vial holder 199 from a raised left-hand position at location 228 for catching vials 49 as they come off the conveyor 210, upwardly overcenter through an arc to a lowered right-hand position 229 for positioning vials 49 in the pill-dispensing module. (See FIG. 3). After the vial 49 is labeled and the pills 48 loaded into the vial 49, the actuators 223 and 226 combine to position the vial 49 at a selected height and lateral position suitable for depositing the vial 49 in one of the channels 230 (FIG. 3) of the filled-vial holding station 231. It is contemplated that all of the filled vials 49 for a particular patient will be unloaded in a single channel 230. Thus, all of the prescriptions will be in one ready location, making it easy for the pharmacist to give the patient all of their prescriptions. The vials 49 can be unloaded from the vial holder 199 into one of the channels 230 by different means. For example, the vial holder 199 can include a release or actuator that motivates the vials 49 out of the vial holder 199. Alternatively, the filled-vial holding station 231 can include projecting fingers that extend to grip a filled vial 49 in the vial holding station 231 to push the filled vial 49 into a selected channel 230.

The prescription information station 56 (FIG. 2) includes a computer 57 with a database for receiving and storing patient prescription information, the printer 58 (FIG. 33) for printing a label for the vial 49 and for applying the label to the vial 49, the screen or monitor 57A (FIG. 2), the keyboard 57B, and other items as required to input, retrieve, and view patient information. The controller 57C (FIG. 33), which includes the computer 57, is operably connected to the components of the pill-dispensing module 47, the retriever module 45, a bulk vial handling device 59, and the printer 58 to control all systems of apparatus 40. It is noted that the computer 57 could be a laptop computer or other separate computer unit, but that it does not need to be a separate stand-alone unit. Instead, it is contemplated that an electronic center could be constructed within the apparatus 40, such as near the pill-dispensing module, that includes computer cards, motherboards, and the like for controlling the apparatus 40.

The present apparatus 40 is highly modular, and takes maximum advantage of off-the-shelf units that can be purchased and used in the apparatus 40 by attachment to the frame 41. By this arrangement, many different options can be added or deleted, based on a pharmacist's preference, or based on a storeowner's preference, or based on customer preferences. For example, the computer can be purchased from Dell Computer; the flat screen HMI can be purchased from Christianson Displays; and the bearing can be purchased from Roll-On.

Figure 36:
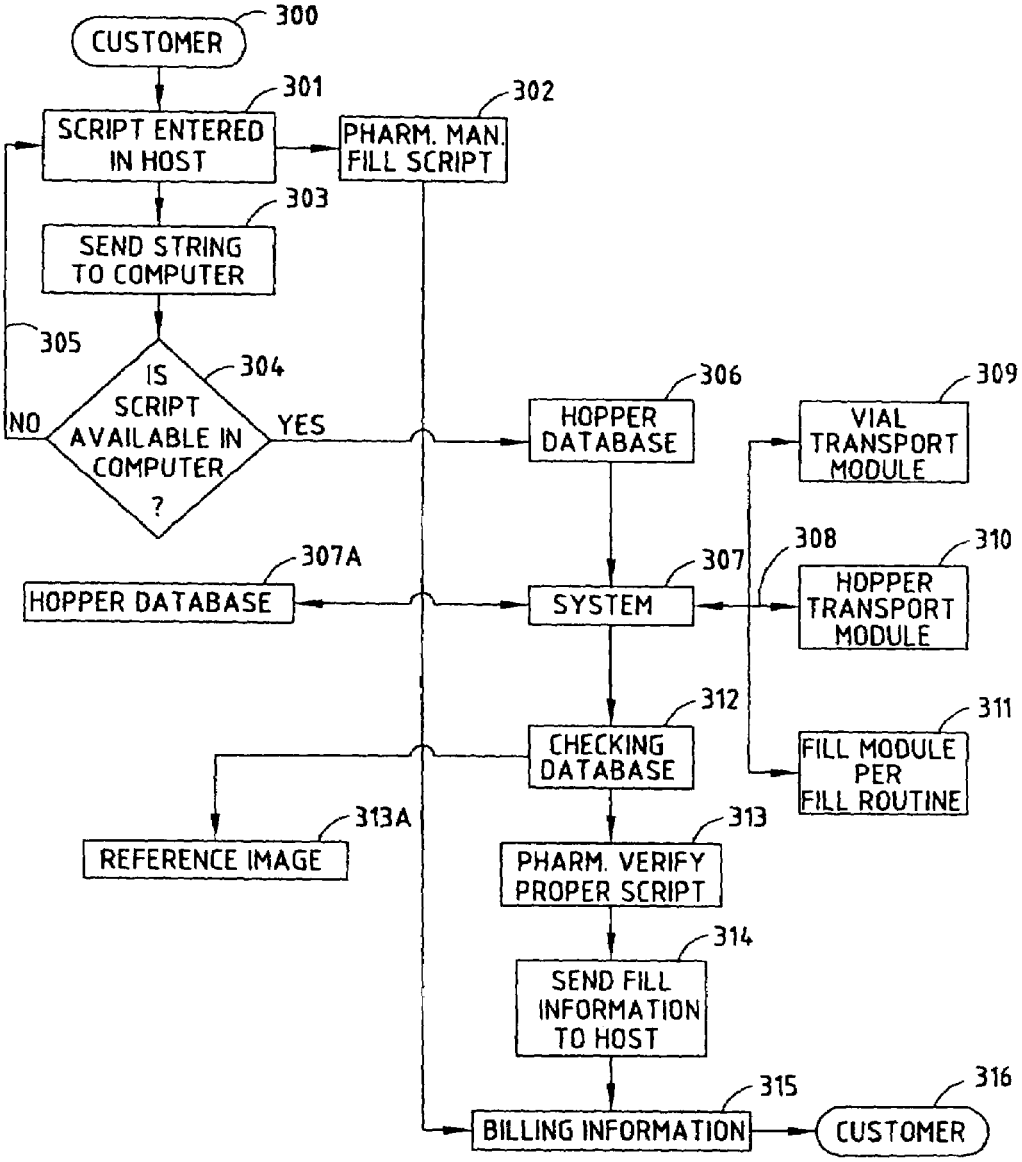
FIGS. 36-38 are flow charts showing the method of script filling, the method of filling vials at the pill-dispensing module, and the method of restocking the storage units.
Figure 37A:
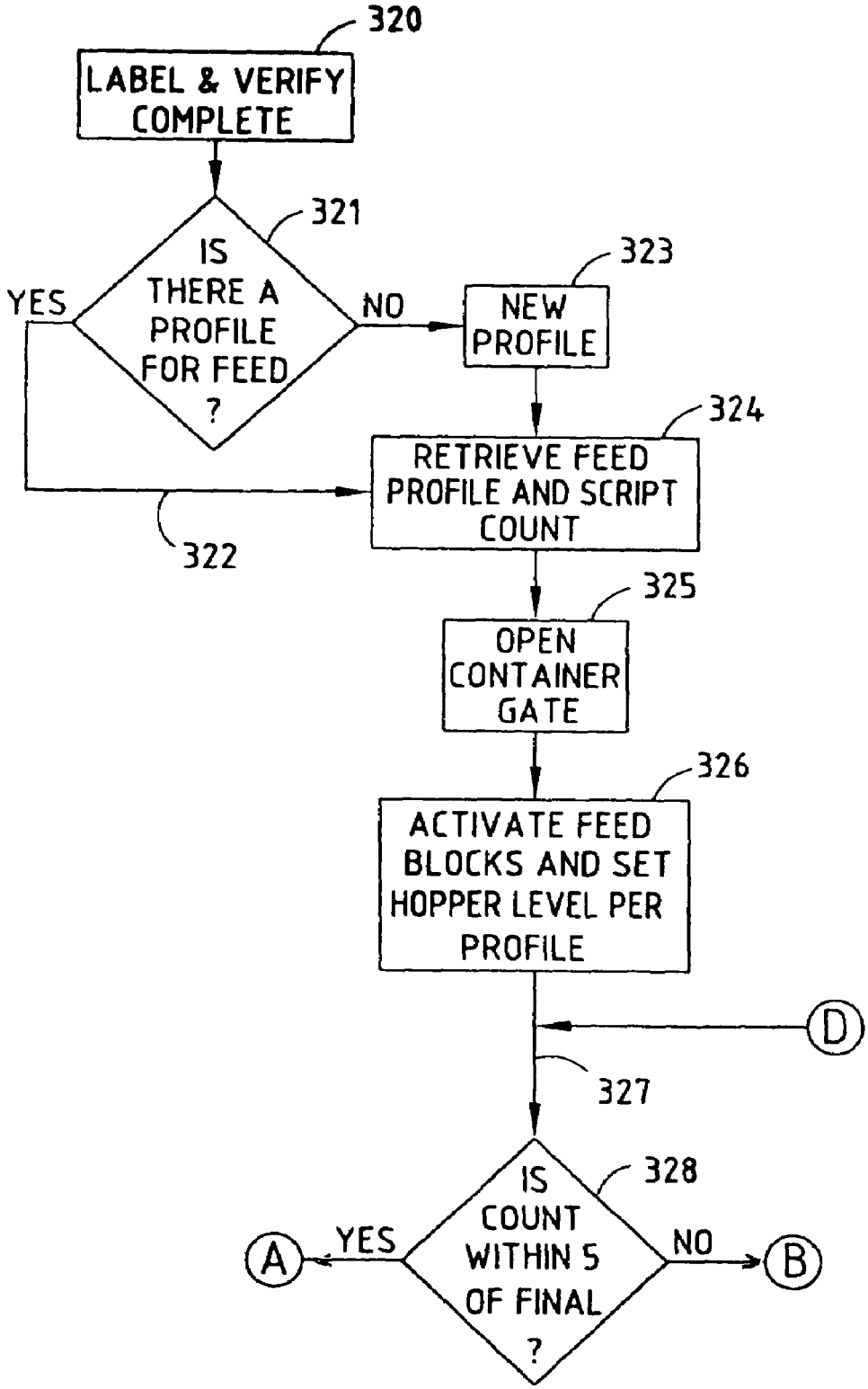
Figure 37B:
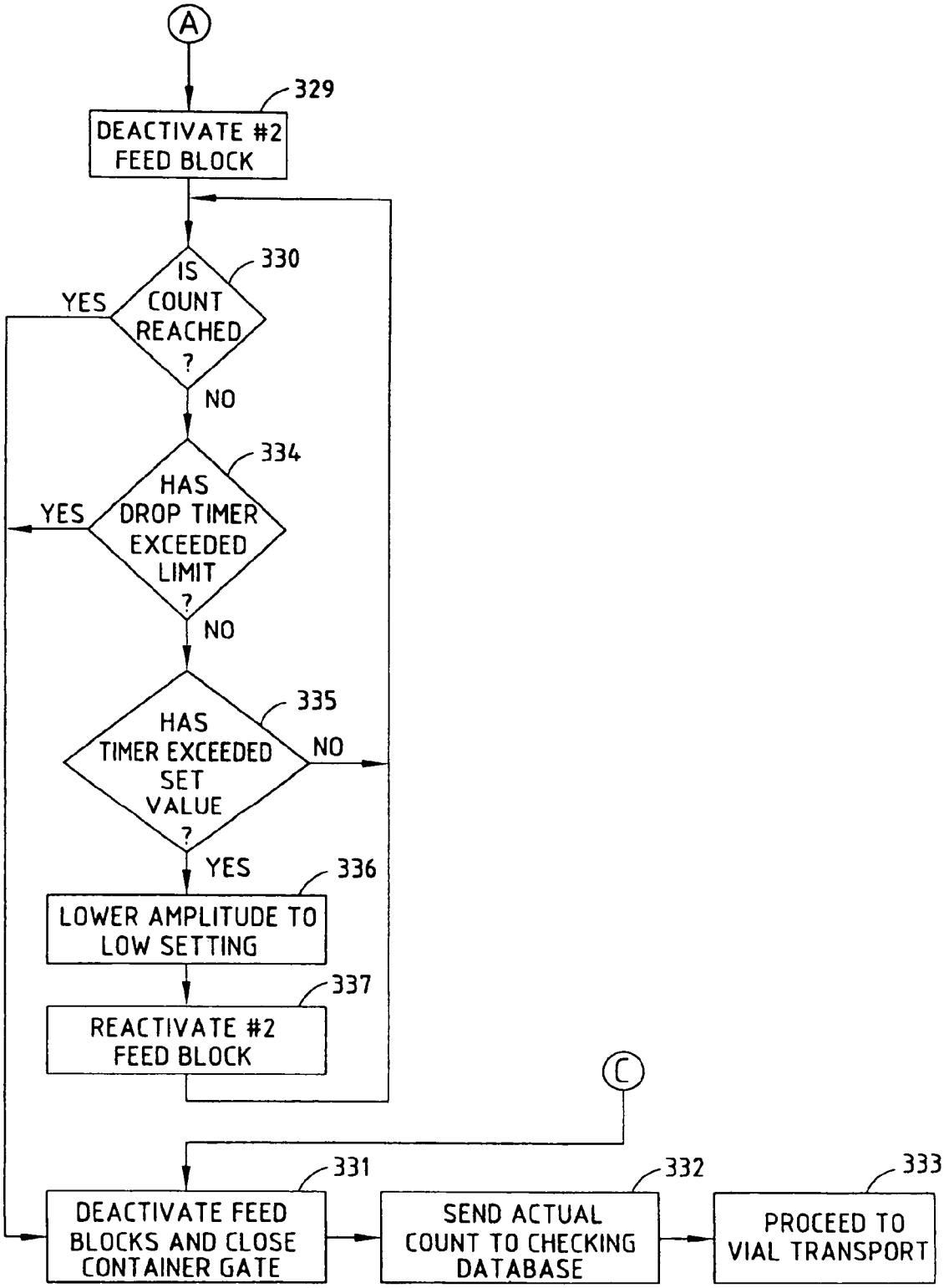
Figure 37C:
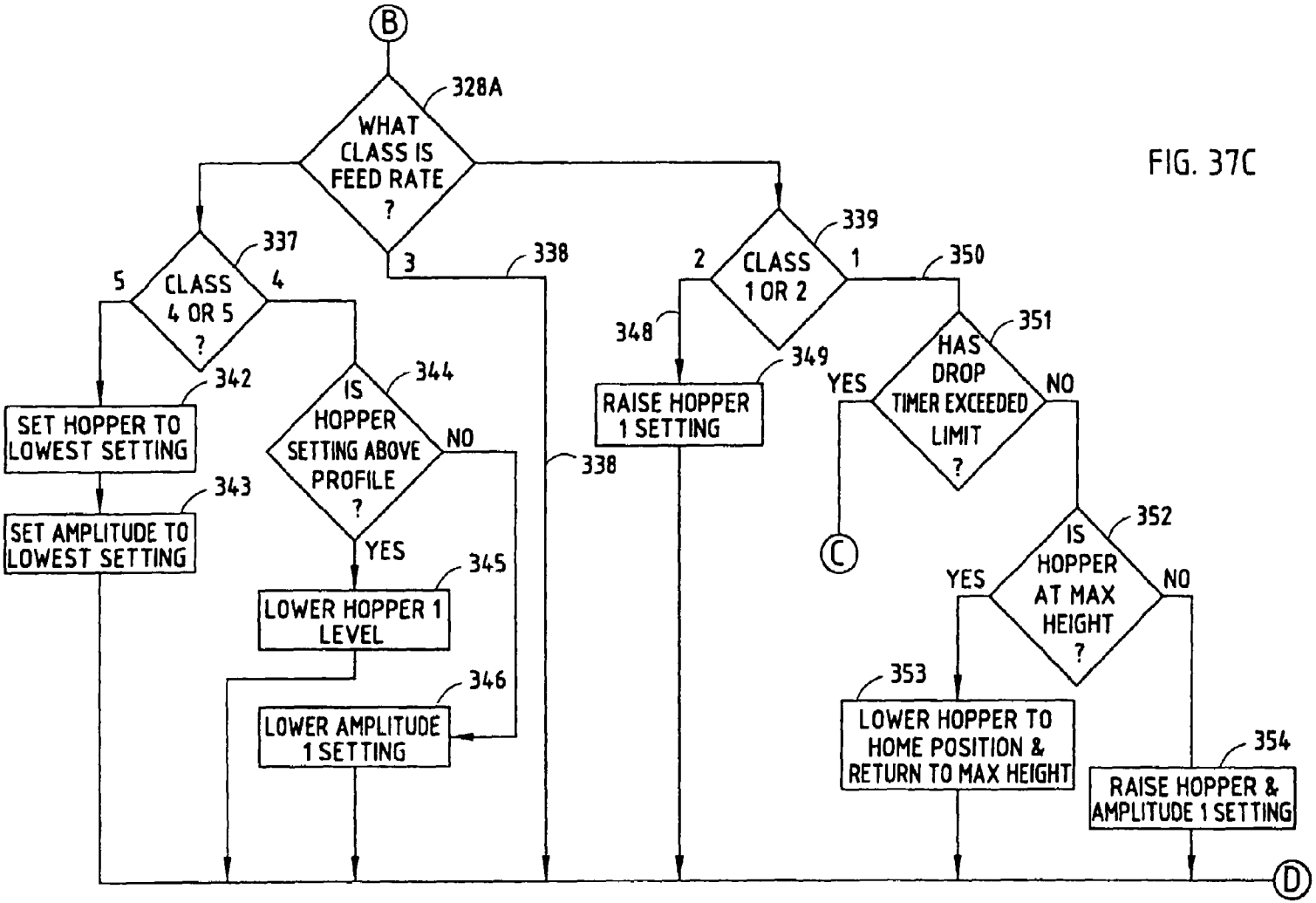
Figure 38:
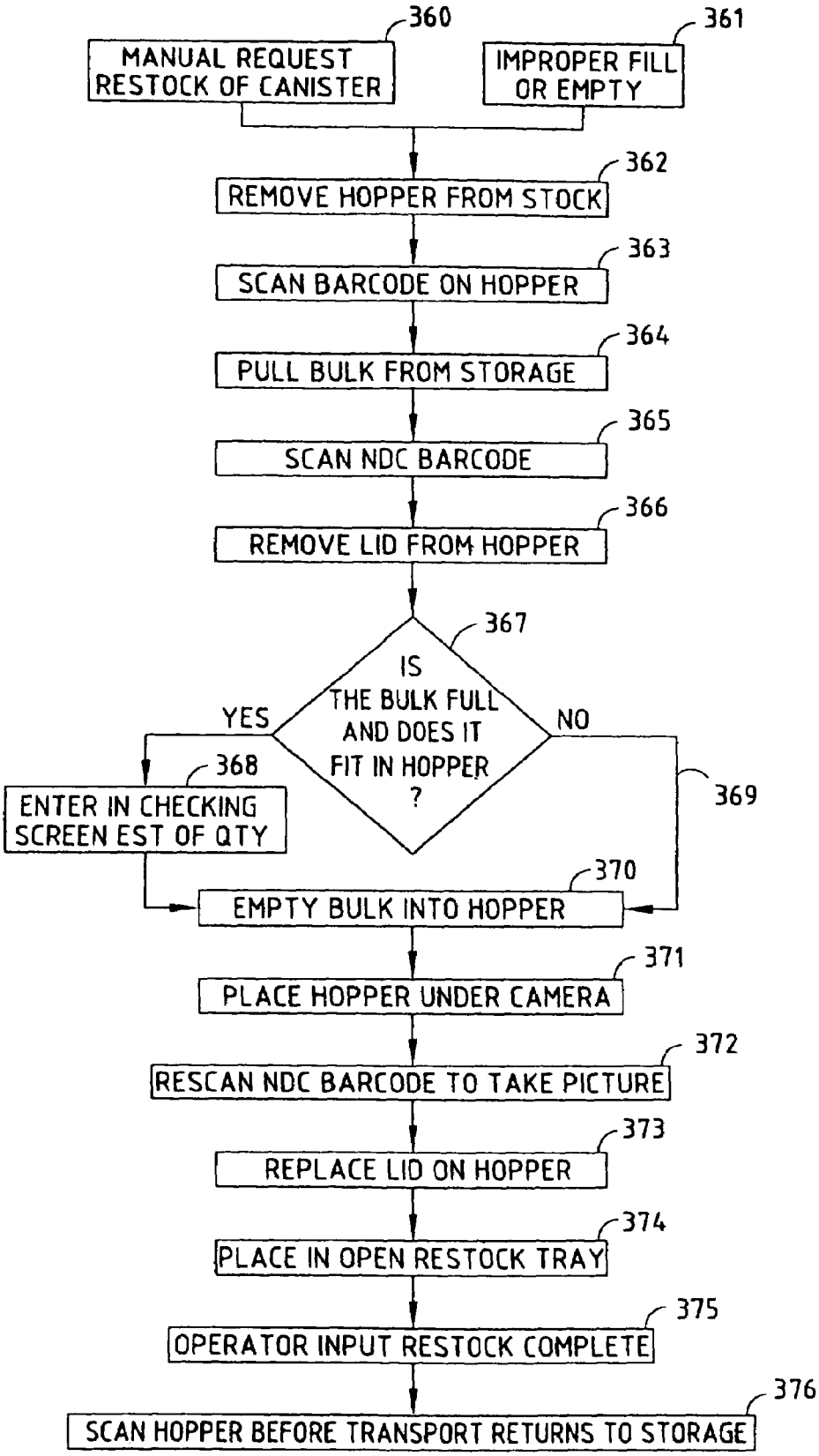

Three preferred methods are shown in FIGS. 36-38. Briefly, they are as follows. Nonetheless, it is contemplated that a number of different variations are possible, while still staying within the parameters of the present inventive concepts.

The method of FIG. 36 includes taking a prescription from a customer in a step 300, and entering the script in a computer in step 301. The pharmacist has the option of manually filling the prescription in step 302, or entering a request (i.e., "sending a string" to the computer) in a step 303. Upon receiving the request in step 304, the computer either returns the script to the pharmacist along a path 305 back to step 301/302 (such as if the computer doesn't recognize the script or can't fill the script), or sends the order to the database portion of the computer 57/controller 57C in step 306. When the order is received in step 306, the system in step 307 refers to the hopper database in step 307A to see if pills are available. If yes, the system in step 308 orders a vial to the pill-dispensing module in step 309 and also orders transport of a hopper of the required pills in step 310. Once the vial and hopper are in place in the pill-dispensing module, the system begins a fill routine in step 311. As part of the vial and hopper being in place, the computer checks the bar code on the prescription label applied to the vial and also the bar code on the hopper/storage unit to assure that the correct drug is being dispensed into the vial. Notably, a top of the vial stays open so that the pharmacist can look at the pills in the filled vial and at the prescription label to double check for accuracy and quality control purposes.

After the vial is filled in step 311, the computer updates the database in step 312. Then, the vial is transported to a holding station, where different prescriptions of the patient are collected. The image (step 313A) of the pill shape, size, type, and name are displayed along with a picture of the pill as the pharmacist picks up the filled vial, in step 313, and the pharmacist verifies the proper script. The fill information is sent to the host computer in step 314, and the billing information is generated in step 315. The prescription is then given to a customer/patient in step 316.

The fill routine shown in FIG. 37 is as follows. The completeness of the label and verification of the hopper contents are performed by a bar code reader in step 320. The computer then determines if there is a feed profile determined for the particular type, size, and shape of the pills being dispensed, in a step 321. If yes, the computer refers to the established feed profile in a step 322. If no, the computer refers to a new feed profile subroutine, in step 323. The new feed profile can begin at an established baseline, or can begin based on preprogrammed data relating to the shape, size, or type of pill being dispensed. Both steps 322 and 323 then lead to step 324, where the computer retrieves the feed profile and script count. The container gate (also called a "door" in the discussion above) is opened in step 325 by an actuator that engages the door and pushes it open. In step 326, the feed blocks or lift pins are adjusted to a desired height to set the hopper level pursuant to the profile desired. The pill counter begins counting pills as the pills drop, in a step 327. In a step 328, the computer repeatedly checks to determine if the pill count is within 5 of a final desired number of pills. If yes, the computer slows down the pill flow by deactivating one of the feed blocks (called a vibrator node, in the discussion above), in step 329. The computer checks to see if the pill count is achieved in step 330. If yes, the computer deactivates the feed blocks and closes the container door or gate in step 331, and sends an actual count signal to the checking database in a step 332. The computer then causes the filled vial to be transported to a holding station for pickup and final checking by the pharmacist in step 333.

If the pill count is not successfully achieved in step 330, (i.e., the pill count is within 5 but does not finish filling), the decision process moves to step 334 instead of to step 331. In step 334, a drop timer is activated. If the pill count is achieved before the timer times out, the computer goes directly to steps 331-333. If no, the process proceeds to step 335, where the computer repeatedly and periodically returns to step 330 until the timer times out. If the pill count is not achieved before the timer times out, the computer decision path moves to step 336 where it lowers the vibrational amplitudes of the vibrator nodes to a different setting, and if necessary, reactivates the second vibrator node in step 337. The computer then again returns to step 330 to determine if the last 5 pills have dropped.

If the count of pills is not within 5 in step 328, then progresses along the "no" decision line to box 328A and then to one of the class profiles in step 337 (class 4 or 5), step 338 (class 3), or step 339 (class 1 or 2). In step 337, the computer determines if class 5 is appropriate, and if yes, the computer sets the hopper to a lowest setting (in step 342) and sets the amplitude to a lowest setting (in step 343), and then returns to step 328. If the computer determines in step 337 that class 4 is appropriate, the computer proceeds in step 344 to determine if the hopper setting is above the profile setting. If yes, in step 345, the hopper is lowered. The computer then returns to step 328. If the computer determines in step 337 that class 4 is appropriate, and also determines in step 344 that the hopper setting is NOT above the profile setting, then the computer proceeds in step 346 to lower the amplitude setting. It then returns to step 338.

If in step 337, the computer moves to step 338 (i.e., class 3) and determines that the feed rate is appropriate, then the computer simply returns to step 328 and begins the cycle again.

If the computer moves to step 339 (i.e., class 1 or 2), and determines that class 2 is appropriate (line 348), the computer raises the hopper (step 349) and then proceeds back to the step 328.

If the computer moves to step 339 (i.e., class 1 or 2) and determines that class 1 is appropriate (line 350), then the computer checks to determine if the drop timer has exceeded its limit (step 351). If yes, the computer moves to deactivate the feed blocks and close the container gate (step 331), sends the actual count to the checking database (step 332) and proceed to vial transport (step 333). If no in step 351, then the computer checks to see if the hopper is at the maximum height in step 352. If yes, it lowers the hopper to a home position and then returns it to a maximum height in step 353. (In other words, it cycles the hopper up and down once to "break" any bunching and bridging of the pills on the track). If no, it raises the hopper and amplitude one setting in step 354. The computer then returns to step 328.

In the restock routing of FIG. 38, the system is entered by a manual request to restock a canister (also called a "storage unit" herein) (step 360) or by an improper fill or empty storage unit (step 361). From step 360 or 361, the computer sends a signal to remove the hopper from the storage location for restock in step 362. The barcode is scanned on the hopper in step 363, and the new bulk supply is pulled from storage in step 364. The barcode is scanned on the new supply/container of bulk pills in step 365. The lid is removed from the hopper of the storage unit in step 366, and it is determined whether the new pills from the new bulk supply will fit into the hopper in step 367. If not, the estimate of quantity added is entered in the computer in step 368. If the exact quantity of added pills is known, this is entered at line 369. The contents of the new bulk supply container are then put into the hopper of the storage unit in step 370. The hopper is placed under a camera in step 371, and the NDC bar code of the new bulk container is rescanned to take a picture in step 372. The lid is then replaced on the hopper of the storage container in step 373, and the storage unit is placed on the restock tray in step 374. The operator then inputs that the restock is complete in step 375. And the hopper is scanned before the transport/retriever returns the refilled storage unit to its storage location in the array of stored units (in step 376). The present refill procedure is highly efficient and accurate, and includes good quality control to prevent errors.

The present apparatus 40 is constructed to operate at a fast prescription/vial fill rate of at least about 110 prescriptions per hour, which is significantly faster than known competitive machines intended for use in retail environments. This speed is achieved in part based on the very high density of pills per total storage space. The speed of the present apparatus 40 is also due in part to the novel linear track, which "immediately" begins dropping pills when activated. (For example, many competitive apparatus have a rotating vibratory feeder where pills must be "lifted" (or moved vertically or slid long distances) as part of their pill singulation process, which takes time). Notably, the short length of the present track also reduces degradation and "dust" from abraded pills, since the pills travel shortest distances. Also, the stored pills are more tightly sealed and protected over many known systems such that sanitation and cleanliness is improved.

According to another embodiment of the present invention, and with reference to FIGS. 39-44, a hopper is constructed to include an auger, i.e., a cylinder having an internal helical ridge. Many of the components of this embodiment of the present invention are similar to or the same as the components discussed above. The auger, when rotated, moves product, e.g., pills, tablets, capsules, etc., from the hopper into a funnel of a fill station (pill-dispensing module), for loading into a product package, e.g., a bottle. The hopper contains a product that is to be dispensed and the product rests on a portion of the auger, which is rotated to move the product from the hopper to the fill station funnel. The hopper may be internally designed to store a variety of product shapes and sizes. In general, the hopper consists of a storage bin with slanted walls and an auger. The auger and its internal helical ridge may be molded from a variety of materials, e.g., Delrin. Further, an auger driven gear may be individually molded and attached to an outlet end of the auger or the driven gear may be integrally molded as part of the outlet end of the auger. Upon selection, a hopper is slid into the fill station, with the hopper initially in a horizontal position. When the hopper is loaded into the fill station, the auger driven gear engages a rotational drive gear (see FIG. 42) that is attached to a shaft of a motor, which is controlled by a control unit (not shown in FIGS. 39-44) of the fill station.

Upon engagement with the fill station, a lift (e.g., a motor and shaft combination, etc.) of the fill station is controlled to initially tip the hopper backwards, such that the inlet of the auger is lower than the outlet of the auger. In doing so, the fill station clears a gate area of the hopper of any bunched product and also helps to load the inlet of the auger, which is especially desirable when the hopper is running low on product. To dispense product, the hopper is generally horizontally positioned, the gate is opened and the auger is rotated. As the auger rotates, the product is pulled towards the auger outlet, irrespective of the position of the hopper, i.e., whether the hopper is tilted or is level. As the product drops from the hopper into the fill station, the product is counted by an external optical counter, which is part of the fill station. The fill station adjusts the speed of the auger and the angle of the hopper in real-time to maintain an optimal flow rate. As the product count nears a final quantity both the speed of the auger and the angle of the hopper are adjusted to slow the flow to a desired rate, which allows sufficient time to close the gate and to cease rotation of the auger. When the requested quantity of the product is reached, the gate is shut to prevent further product from dropping from the hopper into the fill module funnel. The hopper is then leveled to facilitate removal from the fill module.

Figure 39:
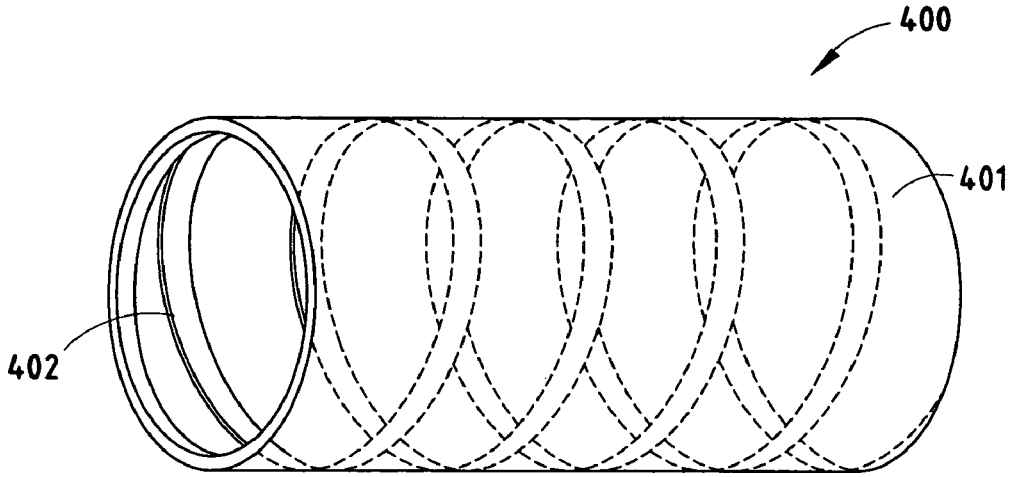
FIG. 39 is a perspective view of a relevant portion of an exemplary auger for moving product, constructed according to one embodiment of the present invention.
Figure 40:
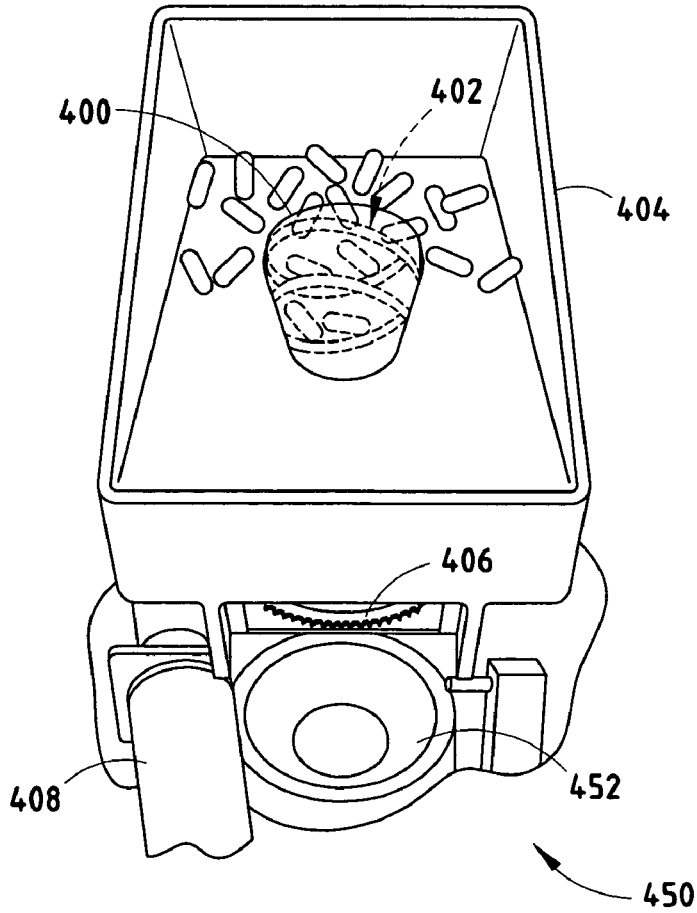
FIG. 40 is a top view of a relevant portion of the auger of FIG. 39, further including a drive gear and positioned within a hopper, which is located at a fill station.
Figure 41:
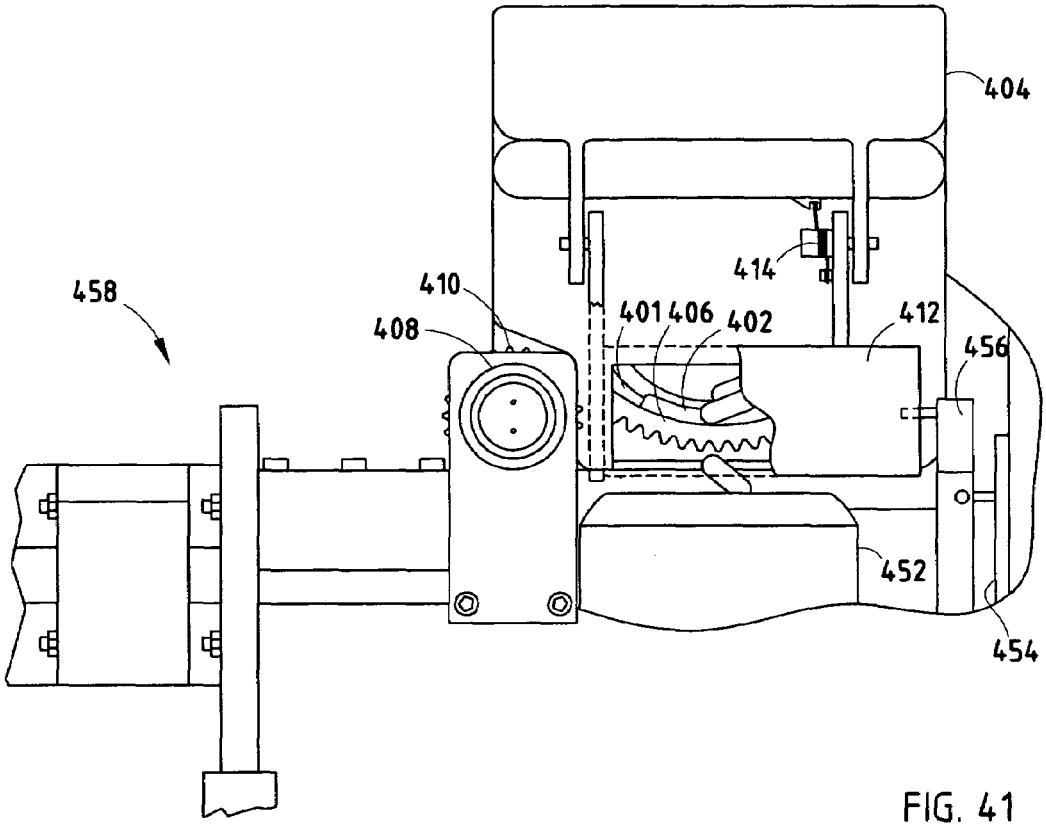
FIG. 41 is a front perspective view of the hopper of FIG. 40, positioned at a fill station, with a gate of the hopper shown in place and partially removed.

With specific reference to FIG. 39, an auger 400 includes a hollow elongated tube 401 having an inner wall that supports a helix ridge 402. As is noted above, an outlet end of the tube carries a driven gear (not shown in FIG. 39) that may be formed as an integral part of the tube 401. As is shown in FIG. 40, the auger 400 is positioned within a hopper 404 that contains a plurality of pills. As is discussed above, an outlet end of the auger 404 includes a driven gear 406 that is integrated along an outer surface of the tube 401. A motor 408, which is part of a fill station 450, has attached to its shaft a drive gear 410 (see FIG. 41) that engages the driven gear 406, when the hopper 400 is fully engaged in the fill station 450 (see FIG. 41). The hopper 404 includes a gate 412 that is biased, in a closed position, by a spring 414. The motor 408 is controlled by a control unit (not shown in FIGS. 39-44) of the fill station 450 to achieve a desired product flow rate from the hopper 404. As is best shown in FIG. 41, product that exits the hopper 404 is received by a funnel 452, which is part of the fill station 450.

Figure 42:
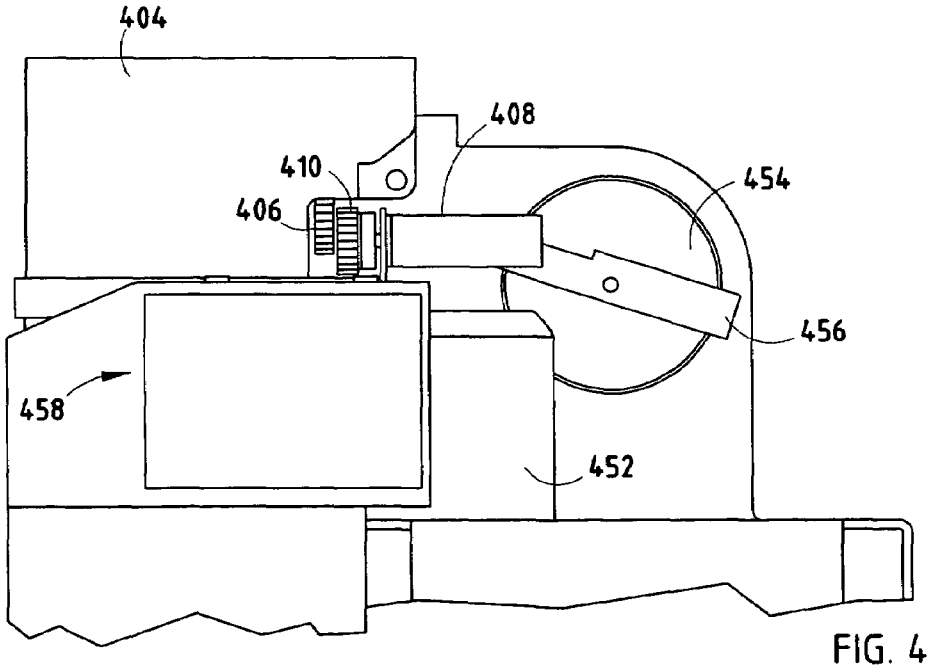
FIG. 42 is a partial side perspective view of the hopper of FIG. 41.
Figure 43:
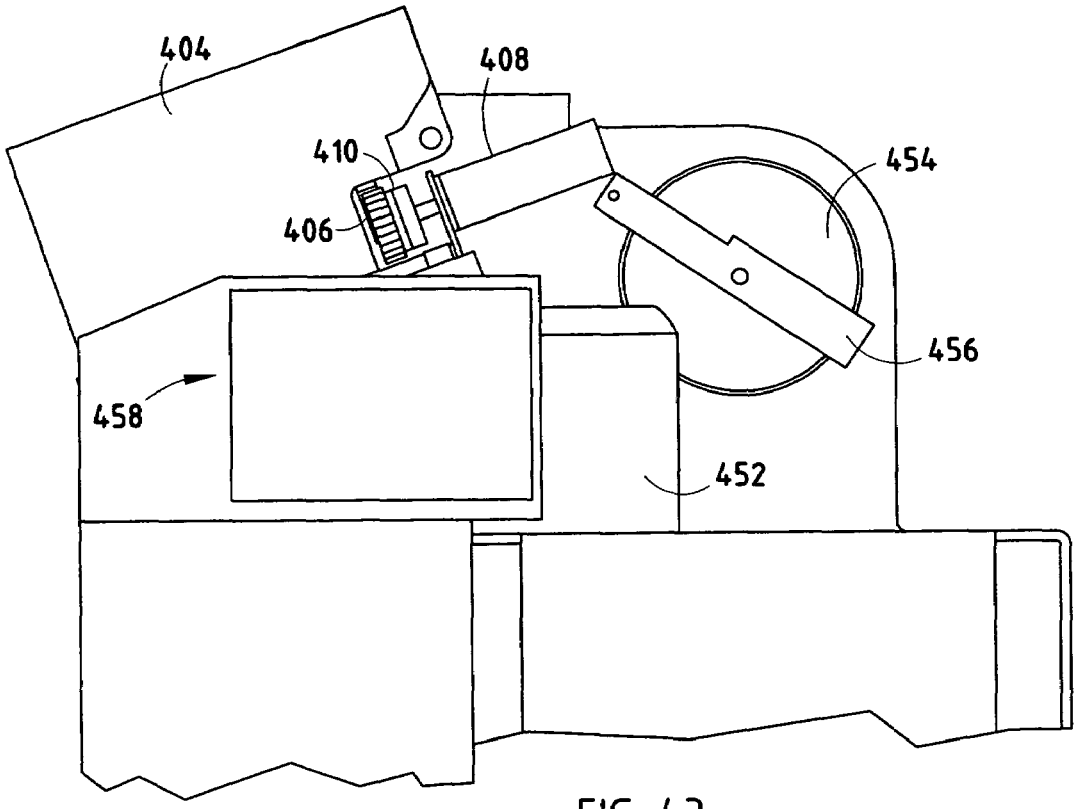
FIG. 43 is a perspective view of the hopper of FIG. 42, shown in a tilted position.
Figure 44:
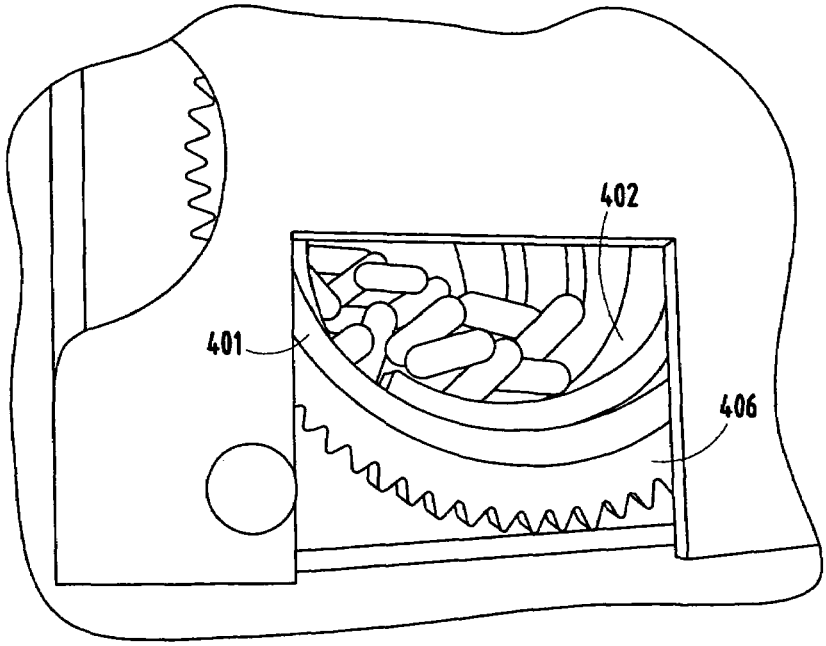
FIG. 44 is a partial end view of the hopper of FIG. 41, which further details the construction of the auger.

With reference to FIG. 42, the gear 406 of the hopper 404 is shown disengaged from the gear 410 of the motor 408. As is shown, the fill station 450 includes a motor 454 that has attached to an end of its shaft a lever 456 that acts upon the gate 412 of the hopper 404, as dictated by the control unit of the fill station 450. A lift 458 of the fill station 450 has positioned the hopper 404 in a tilted position. The lift 458 may be controlled to place the hopper 404 in a range of positions. With reference to FIG. 44, the helical ridge 402 of the tube 401 is depicted in further detail. The ridge 402 may have, for example, a height of about 0.125 inches, a width of about 0.3125 inches and side walls sloped at about 30 degrees.

In one embodiment, an additional short section (e.g., extending from the auger edge into the auger approximately 0.5 inches at 30 degrees from the outlet edge) of helical ridge may be incorporated into the inner surface of the tube 401, approximate the outlet of the tube 401, to provide a double helix at the end of the auger 400. The double helix functions to split clumps of small pills into two feeds, as one ridge pushes pills to the edge of the auger for immediate exit and the other ridge carries pills around the auger for one-hundred eighty degrees before pushing the pills to the edge of the auger for exit from the auger. In general, this increases speed and accuracy of product delivery, as well as providing a passive technique that feeds both small and large pills from the same auger utilizing only flow regulating software.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A pill-dispensing apparatus for automatically dispensing solid pills, comprising:

a plurality of storage units for storing pills in bulk, each storage unit including a hopper and an auger movably positioned with respect to the hopper, wherein an inlet of the auger is positioned to receive pills from the hopper, and wherein the auger includes a helical ridge integrated into an inner surface of the auger; and a pill-dispensing module including a dock selectively separable from the storage units and for receiving and holding a selected one of the storage units, a drive unit for rotating the auger of the selected one of the storage units to motivate the pills along the auger of the selected one of the storage units, a pill counter for counting pills dispensed from an auger outlet, and a lift for tilting the hopper of the selected one of the storage units to control flow and to assist in motivating pills to fall from the hopper of the selected one of the storage units and move along the auger of the selected one of the storage units;

wherein each storage unit can be selectively received and held by the dock, with the drive unit of the pill-dispensing module being able to rotate the auger of the selected one of the storage units.

2. The pill-dispensing apparatus of claim 1, including a vial handler for holding a vial under the pill-dispensing module for receiving the dispensed pills.

3. The pill-dispensing apparatus of claim 1, including a prescription information station including a computer operably connected to the pill-dispensing module for receiving patient prescription information.

4. A pill-dispensing apparatus for automatically dispensing solid pills, comprising:

a plurality of storage units for storing pills in bulk, each storage unit including a hopper and an auger movably positioned with respect to the hopper, wherein an inlet of the auger is positioned to receive pills from the hopper, and wherein the auger includes a helical ridge integrated into an inner surface of the auger;

a pill-dispensing module including a dock for receiving and holding a selected one of the storage units, a drive unit for rotating the auger to motivate the pills along the auger, a pill counter for counting pills dispensed from an auger outlet, and a lift for tilting the hopper to control flow and to assist in motivating pills to fall from the hopper and move along the auger; and a mobile frame, the storage units being supported on the mobile frame, and including a retriever operably supported on the frame for retrieving a selected one of the storage units based on prescription information and for positioning the selected one storage unit in the pill-dispensing module.

5. The pill-dispensing apparatus of claim 4, including a bulk vial handler on the mobile frame for holding a vial under the pill-dispensing module for receiving the dispensed pills.

6. The pill-dispensing apparatus of claim 5, including a prescription information station including a computer operably connected to the retriever for receiving patient prescription information.

7. The pill-dispensing apparatus of claim 6, including a printer for printing a label for the vial and for applying the label to the vial.

8. The pill-dispensing apparatus of claim 7, including a control system for operating the pill-dispensing module, the retriever, the vial handler, and the printer.

9. A method for dispensing solid pills, comprising the steps of:

providing a plurality of storage units for storing pills in bulk, each storage unit including a hopper and an auger movably positioned with respect to the hopper, wherein an inlet of the auger is positioned to receive pills from the hopper, and wherein the auger includes a helical ridge integrated into an inner surface of the auger;

providing a pill-dispensing module including a dock selectively separable from the storage units and for receiving and holding a selected one of the storage units, a drive unit for rotating the auger of the selected one of the storage units to motivate the pills along the auger of the selected one of the storage units, a pill counter for counting pills dispensed from an auger outlet, and a lift for tilting the hopper of the selected one of the storage units to control flow and to assist in motivating pills to fall from the hopper of the selected one of the storage units and move along the auger of the selected one of the storage units;

wherein each storage unit can be selectively received and held by the dock, with the drive unit of the pill-dispensing module being able to rotate the auger of the selected one of the storage units.

10. The method of claim 9, further comprising the step of:

providing a vial handler for holding a vial under the pill-dispensing module for receiving the dispensed pills.

11. The method of claim 9, further comprising the step of:

providing a prescription information station including a computer operably connected to the pill-dispensing module for receiving patient prescription information.

12. A method for dispensing solid pills, comprising the steps of:

providing a plurality of storage units for storing pills in bulk, each storage unit including a hopper and an auger movably positioned with respect to the hopper, wherein an inlet of the auger is positioned to receive pills from the hopper, and wherein the auger includes a helical ridge integrated into an inner surface of the auger;

providing a pill-dispensing module including a dock for receiving and holding a selected one of the storage units, a drive unit for rotating the auger to motivate the pills along the auger, a pill counter for counting pills dispensed from an auger outlet, and a lift for tilting the hopper to control flow and to assist in motivating pills to fall from the hopper and move along the auger;

providing a mobile frame, wherein the storage units are supported on the mobile frame; and providing a retriever operably supported on the frame for retrieving a selected one of the storage units based on prescription information and for positioning the selected one storage unit in the pill-dispensing module.

13. The method of claim 12, further comprising the step of:

providing a bulk vial handler on the mobile frame for holding a vial under the pill-dispensing module for receiving the dispensed pills.

14. The method of claim 13, further comprising the step of:

providing a prescription information station including a computer operably connected to the retriever for receiving patient prescription information.

15. The method of claim 14, further comprising the step of:

providing a printer for printing a label for the vial and for applying the label to the vial.

16. The method of claim 15, further comprising the step of:

providing a control system for operating the pill-dispensing module, the retriever, the vial handler, and the printer.

17. A pill-dispensing apparatus for automatically dispensing solid pills, comprising:

a plurality of storage units for storing pills in bulk, each storage unit including a hopper and an auger movably positioned with respect to the hopper, wherein an inlet of the auger is positioned to receive pills from the hopper, and wherein the auger includes a helical ridge integrated into an inner surface of the auger; and a pill-dispensing module including a dock selectively separable from the storage units and for receiving and holding a selected one of the storage units, a drive unit for rotating the auger of the selected one of the storage units to motivate the pills along the auger of the selected one of the storage units, and a lift for tilting the hopper of the selected one of the storage units to control flow and to assist in motivating pills to fall from the hopper of the selected one of the storage units and move along the auger of the selected one of the storage units;

wherein each storage unit can be selectively received and held by the dock, with the drive unit of the pill-dispensing module being able to rotate the auger of the selected one of the storage units.

18. The pill-dispensing apparatus of claim 17, wherein the helical ridge is continuous and has a height of about 0.125 inches and a width of about 0.312 inches.

19. The pill-dispensing apparatus of claim 17, wherein the helical ridge is continuous and includes an additional short section of helical ridge extending from an outlet edge of the auger into the auger about 0.5 inches at about thirty degrees from the outlet edge.

20. The pill-dispensing apparatus of claim 18, wherein the helical ridge is continuous and includes an additional short section of helical ridge extending from an outlet edge of the auger into the auger about 0.5 inches at about thirty degrees from the outlet edge.

* * * * *

UNITED STATES PATENT AND TRADEMARK OFFICE

CERTIFICATE OF CORRECTION

PATENT NO. : 7,624,894 B2
APPLICATION NO. : 11/193174
DATED : December 1, 2009
INVENTOR(S) : Gerold et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 253 days.

Signed and Sealed this

Twenty-sixth Day of October, 2010

David J. Kappos

David J. Kappos
*Director of the United States Patent and Trademark Office*